US008079887B2

(12) United States Patent
Kato et al.

(10) Patent No.: US 8,079,887 B2
(45) Date of Patent: Dec. 20, 2011

(54) FUEL SUPPLY SYSTEM FOR BOAT AND OUTBOARD MOTOR

(75) Inventors: Masahiko Kato, Shizuoka (JP); Yoshiyuki Kadobayashi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 183 days.

(21) Appl. No.: 12/473,290

(22) Filed: May 28, 2009

(65) Prior Publication Data

US 2009/0298364 A1 Dec. 3, 2009

(30) Foreign Application Priority Data

May 30, 2008 (JP) ..... 2008-142566

(51) Int. Cl.
*F02B 61/04* (2006.01)
*F02M 37/00* (2006.01)

(52) U.S. Cl. ..... 440/88 F

(58) Field of Classification Search ..... 440/88 F; 123/468, 469, 470, 471, 472, 509–511, 514, 123/516, 73 SC
See application file for complete search history.

(56) References Cited

U.S. PATENT DOCUMENTS 4,794,889 A * 1/1989 Hensel ..... 123/73 SC
5,309,885 A * 5/1994 Rawlings et al. ..... 123/509
5,555,858 A * 9/1996 Katoh ..... 123/73 SC
5,647,331 A * 7/1997 Swanson ..... 123/516
5,829,402 A * 11/1998 Takahashi et al. ..... 123/184.24

FOREIGN PATENT DOCUMENTS

JP 09-088623 A 3/1997
JP 2001-140720 A 5/2001

OTHER PUBLICATIONS

Kato et al.; "Fuel Supply System for Boat and Outboard Motor"; U.S. Appl. No. 12/473,291, filed May 28, 2009.
Kato et al.; "Fuel Supply System for Boat and Outboard Motor"; U.S. Appl. No. 12/473,293, filed May 28, 2009.
Kato et al.; "Fuel Supply System for Boat and Outboard Motor"; U.S. Appl. No. 12/473,294, filed May 28, 2009.

* cited by examiner

*Primary Examiner* — Daniel Venne
(74) *Attorney, Agent, or Firm* — Keating & Bennett, LLP

(57) ABSTRACT

A fuel supply system for a boat includes a vapor separator tank connected to a fuel tank mounted on a hull of the boat to contain fuel therein, an injector to supply fuel to an engine, and a high-pressure fuel pump to supply fuel that is contained in the vapor separator tank to the injector. The high-pressure fuel pump includes a pump main portion having a fuel path and a pump driving section that are separated from the fuel path of the pump main portion. The fuel supply system minimizes deterioration in engine startability.

15 Claims, 24 Drawing Sheets

FUEL SUPPLY SYSTEM FOR BOAT AND OUTBOARD MOTOR

BACKGROUND OF THE INVENTION

1. Field of the Invention

The present invention relates to a fuel supply system for a boat and an outboard motor. Specifically, the present invention relates to a fuel supply system for a boat having a fuel supply pump and an outboard motor. The fuel supply pump supplies the fuel contained in a second fuel tank connected to a first fuel tank mounted on a hull to a fuel injection device.

2. Description of the Related Art

Conventionally, a fuel supply system for a boat having a fuel supply pump that supplies the fuel contained in a second fuel tank connected to a first fuel tank mounted on a hull to a fuel injection device is known (See, JP A 2001-140720 and JP A Hei 9-88623, for example).

The fuel supply system for a boat described in JP A 2001-140720 and JP A Hei 9-88623 is a fuel supply system for a boat having an outboard motor. In JP A 2001-140720 and JP A Hei 9-88623, fuel pumped from a fuel tank (first fuel tank) mounted on a hull is contained in a vapor separator tank (second fuel tank). The fuel contained in the vapor separator tank is supplied to a fuel injection device by a fuel supply pump. A regulator is provided between the fuel injection device and the vapor separator tank and is configured such that surplus fuel is returned to the vapor separator tank via the regulator in the case where the pressure of the fuel pumped by the fuel supply pump is larger than a predetermined value. Also, JP A 2001-140720 and JP A Hei 9-88623 use a so-called in-tank fuel supply pump that is disposed in the vapor separator tank. Generally, the in-tank fuel supply pump described above is configured to drive a pump main portion by a motor. In the in-tank fuel supply pump, fuel flows through the inside of the motor when the pump main portion is driven to supply the fuel to the fuel injection device. This configuration makes it possible to cool the heated motor with the fuel.

However, as described above, in the case where fuel flows through the inside of the motor when being supplied to the fuel injection device, the fuel temperature is increased by heat generated by the motor. A portion of the heated fuel is returned to the vapor separator tank by the regulator. Thus, when an engine is continuously operated, the temperature of the fuel in the vapor separator tank gradually increases due to the heat from the motor, which facilitates the generation of vapor (vaporized fuel) in the vapor separator tank. When the engine is stopped after a heavily-loaded operation of the boat, the temperature of the fuel in the vapor separator tank is further increased by heat radiated from the heated engine. This further accelerates vaporization of the fuel, and the vaporized fuel is returned to the fuel tank that is mounted on the hull. In this case, fuel in the vapor separator tank decreases due to the vaporized fuel that is returned to the fuel tank mounted on the hull. For the above reason, because it takes more time to pump fuel up to the vapor separator tank from the fuel tank on the hull during a restart of the engine, it is difficult for the fuel supply pump to efficiently pump fuel up from the vapor separator tank to supply fuel to the fuel injection device. As a result, this hampers smooth engine starting.

SUMMARY OF THE INVENTION

In order to overcome the problems described above, preferred embodiments of the present invention provide a fuel supply system for a boat and an outboard motor that minimizes the difficulty in starting an engine.

A fuel supply system for a boat according to a first preferred embodiment of the present invention includes a second fuel tank connected to a first fuel tank mounted on a hull and arranged to contain fuel therein, a fuel injection device arranged to supply fuel to an engine, and a fuel supply pump including a pump main portion having a fuel passage or fuel path, hereinafter referred to as a fuel path, and a pump driving section separated from the fuel path of the pump main portion and arranged to supply fuel contained in the second fuel tank to the fuel injection device.

In the fuel supply system for a boat according to the first preferred embodiment, as described above, a fuel supply pump includes the pump main portion having the fuel path and the pump driving section separated from the fuel path of the pump main portion. Consequently, even when the pump driving section generates heat, an increase in the temperature of the fuel in the fuel path of the pump main portion caused by the heat generated in the pump driving section can be minimized. Accordingly, it is possible to minimize the generation of vapor (vaporized fuel) in the second fuel tank, and thus it is possible to prevent fuel from vaporizing and returning to the first fuel tank mounted on the hull. Therefore, it is possible to minimize the reduction of fuel in the second fuel tank. This allows the fuel supply pump to easily pump fuel up from the second fuel tank and supply the fuel to the injection device during a restart of the engine. As a result, deterioration in engine startability can be minimized.

In the fuel supply system for a boat according to the first preferred embodiment, the fuel supply pump is preferably disposed outside the second fuel tank. With this configuration, fuel can be pumped up from the second fuel tank and supplied to the fuel injection device by utilizing a so-called in-line fuel pump that is interposed between fuel pipes. Thus, it is easy to configure the fuel supply pump that includes the pump main portion having the fuel path and the pump driving section separated from the fuel path of the pump main portion.

In the fuel supply system for a boat according to the first preferred embodiment, the pump driving section is preferably configured to drive the pump main portion by the driving force of the engine. With this configuration, an extra driving source such as a motor is not required as the pump driving section. Therefore, unlike the case where a motor is utilized as the pump driving section, the pump driving section generates no heat, and thus an increase in the fuel temperature can be minimized. Since the pump driving section drives the pump main portion by the driving force of the engine, the pump driving section can be driven at a high speed that corresponds to the engine speed to automatically supply a sufficient amount of fuel to the fuel injection device when the engine operates at high speed and needs a large amount of fuel. Meanwhile, when the engine operates at low speed and needs less fuel, the pump driving section is driven at a low speed that corresponds to the engine speed to automatically supply less fuel to the injection device. Thus, only a required amount of fuel can be supplied to the fuel injection device. Therefore, it is possible to reduce a surplus amount of fuel that returns from the fuel injection device to the second fuel tank. This prevents the return of heated fuel to the second fuel tank even when the fuel temperature increases in the pump main portion, thereby minimizing an increase in the fuel temperature in the second fuel tank. As a result, the generation of vapor in the second fuel tank can be further minimized.

In the fuel supply system for a boat according to a preferred embodiment, the pump main portion is preferably configured to be driven by the driving force of a motor that is separated from the fuel path of the pump main portion. With this configuration, an increase in the temperature of fuel in the fuel path of the pump main portion that is caused by heat from the motor can be minimized even when a motor is utilized to drive the pump main portion. Also, in the case where the hull is stored for a long period, it is possible to prevent foreign matter and the like extracted from the fuel from adhering to the inside of the motor. Thus, failure of the motor can be minimized.

In the fuel supply system for a boat according to the first preferred embodiment, the second fuel tank and the fuel supply pump are preferably spaced away from the engine. With this configuration, since the second fuel tank and the fuel supply pump are not directly attached to the engine, it is possible to minimize direct transmission of heat from the engine to the second fuel tank and the fuel supply pump. Thus, a temperature increase in the second fuel tank and the fuel supply pump can be minimized, thereby minimizing the generation of vapor in the second fuel tank and the fuel supply pump.

In the fuel supply system for a boat according to the first preferred embodiment, the fuel supply pump preferably further includes a pressure adjusting device arranged to return fuel when the pressure of the fuel that is supplied to the fuel injection device is equal to or larger than a predetermined value. With this configuration, the pressure adjusting device installed in the fuel supply pump can release fuel when the injection device is plugged, for example. This prevents the fuel injection device and the fuel supply pump from being damaged by the excessive fuel pressure.

In this case, preferably, the second fuel tank includes a vapor separator tank arranged to separate the vaporized fuel from the liquid fuel, and the pressure adjusting device is configured to return fuel to the vapor separator tank when the pressure of the fuel that is supplied to the injection device is equal to or larger than a predetermined value. With this configuration, even when the fuel temperature increases to generate vapor in the pump main portion, it is possible to return the vapor to the second fuel tank and separate the vapor from the liquid fuel. This prevents vapor (vaporized fuel) from collecting in the pump main portion of the fuel supply pump, and thus it is possible to minimize uncontrolled fuel supply to the fuel injection device that is caused by collected vapor in the pump main portion.

In the fuel supply system for a boat according to the first preferred embodiment, the fuel supply pump preferably has a heat insulating structure that insulates heat radiated by the engine. With this configuration, an increase in the temperature of the fuel in the fuel supply pump that is caused by heat radiated from the engine can be minimized. This minimizes the generation of vapor in the pump main portion.

In this case, the pump main portion of the fuel supply pump is preferably made of resin (e.g., a plastic or any other suitable polymeric material or material having low thermal conductivity, hereinafter referred to generally as a resin) as a base material, which forms the heat insulating structure. With this configuration, the fuel supply pump can easily be made of resin. In addition, with the use of resin, which generally has a low thermal conductivity, as a base material, it is possible to minimize an increase in the fuel temperature in the pump main portion that is caused by heat radiated from the engine. This easily minimizes the generation of vapor in the pump main portion.

In the fuel supply system for a boat according to the first preferred embodiment, the fuel supply pump preferably includes a first cooling section arranged to cool the pump main portion. With this configuration, because the first cooling section can cool the fuel in the pump main portion, it is possible to effectively minimize an increase in the fuel temperature in the pump main portion that is caused by the heat radiated from the engine. This effectively minimizes the generation of vapor in the pump main portion.

In the fuel supply system for a boat according to the first preferred embodiment, the second fuel tank preferably has a heat insulating structure that insulates the second fuel tank from the heat radiated from the engine. With this configuration, it is possible to minimize an increase in the fuel temperature in the second fuel tank that is caused by the heat radiated from the engine. This minimizes the generation of vapor in the second fuel tank.

In this case, the second fuel tank is preferably made of resin as a base material, which forms the heat insulating structure. With this configuration, the second fuel tank can easily be made of resin. With the use of the resin, which generally has a low thermal conductivity, as a base material, it is possible to minimize an increase in the fuel temperature in the second fuel tank that is caused by the heat radiated from the engine. This easily minimizes the generation of vapor in the second fuel tank.

In the fuel supply system for a boat according to the first preferred embodiment, the second fuel tank preferably includes a second cooling section that cools the second fuel tank. With this configuration, because the second cooling section can cool the fuel in the second fuel tank, it is possible to effectively minimize an increase in the fuel temperature in the second fuel tank that is caused by the heat radiated from the engine. This effectively minimizes the generation of vapor in the second fuel tank.

Preferably, the fuel supply system for a boat according to the first preferred embodiment further includes a fuel transport pump arranged to transport fuel from the first fuel tank to the second fuel tank, and the fuel transport pump includes a third cooling section arranged to cool the fuel transport pump. With this configuration, because the third cooling section can cool the fuel in the fuel transport pump, it is possible to effectively minimize an increase in the fuel temperature in the fuel transport pump that is caused by the heat radiated from the engine or direct heat transferred from the engine. This effectively minimizes the generation of vapor in the fuel transport pump.

An outboard motor according to a second preferred embodiment of the present invention includes a second fuel tank connected to a first fuel tank mounted on a hull and arranged to contain fuel therein, an engine, a fuel injection device arranged to supply fuel to the engine, and a fuel supply pump including a pump main portion having a fuel path and a pump driving section separated from the fuel path of the pump main portion and arranged to supply the fuel contained in the second fuel tank to the fuel injection device.

In the outboard motor according to the second preferred embodiment, as described above, the fuel supply pump includes the pump main portion having the fuel path and the pump driving section separated from the fuel path of the pump main portion. Therefore, it is possible to minimize an increase in the fuel temperature in the fuel path of the pump main portion that is caused by the heat generated in the pump driving section. Accordingly, it is possible to minimize the generation of vapor (vaporized fuel) in the second fuel tank and thus to prevent fuel from vaporizing and returning to the first fuel tank mounted on the hull. Therefore, it is possible to minimize the reduction of fuel in the second fuel tank. This allows the fuel supply pump to easily pump fuel up from the second fuel tank and supply the fuel to the injection device during a restart of the engine. As a result, deterioration in engine startability can be minimized.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention are described below with reference to the accompanying drawings.

Figure 1:
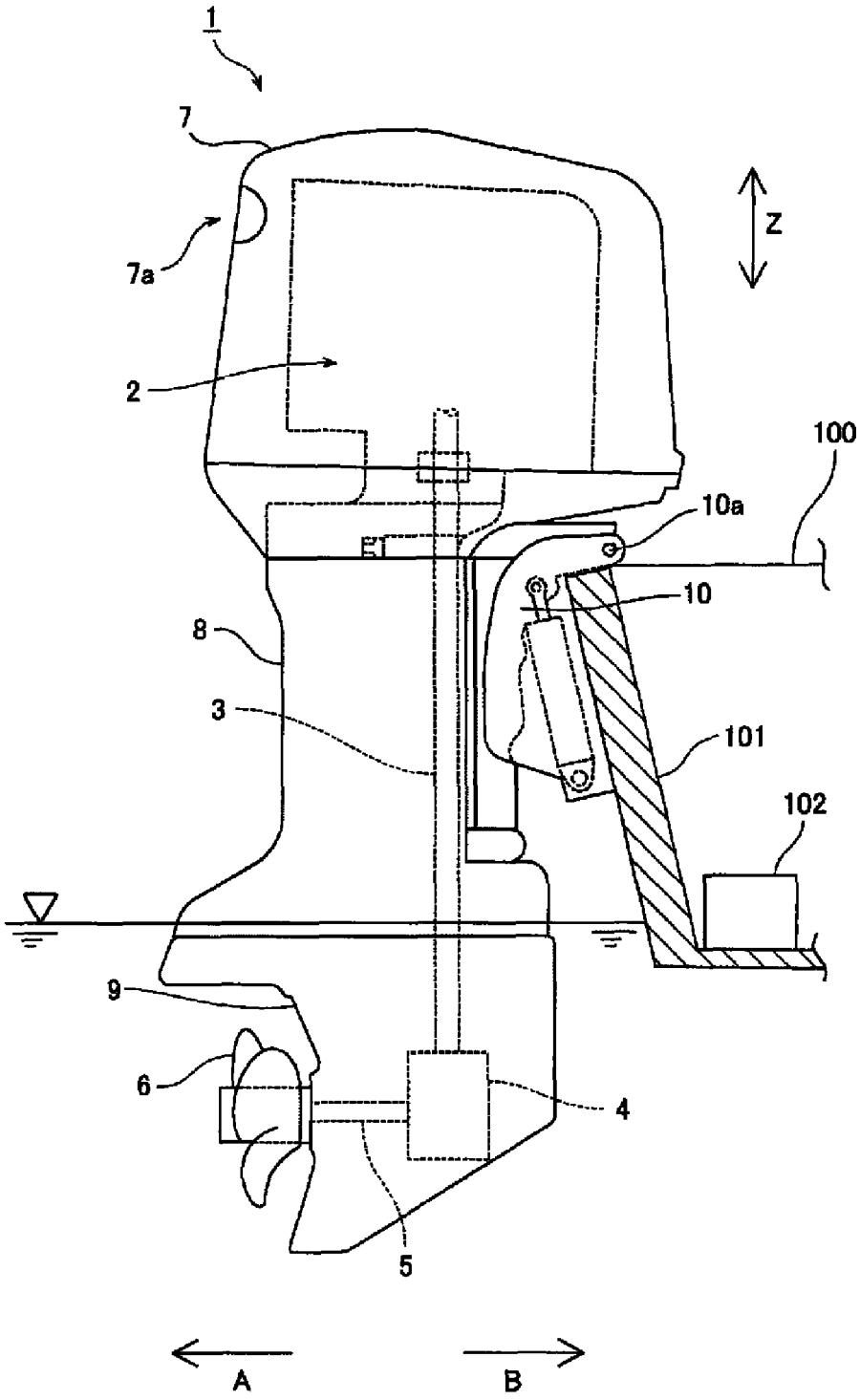
FIG. 1 is a side view showing a general construction of an outboard motor according to a preferred embodiment of the present invention.

FIG. 1 is a side view showing an overall configuration of an outboard motor that includes a fuel supply system for a boat according to a preferred embodiment of the present invention. FIGS. 2 to 14 are illustrations showing the detailed structure of an engine of the outboard motor shown in FIG. 1. FIG. 14 is a schematic diagram showing functions of each component defining the fuel supply system for a boat. The arrangement of each component (especially the location of a high-pressure fuel pump) in FIG. 14 is different from that in FIGS. 2 to 8. First, referring to FIGS. 1 to 14, a structure of an outboard motor 1 provided with a fuel supply system for a boat according to a preferred embodiment of the present invention will be described.

As shown in FIG. 1, the outboard motor 1 includes an engine section 2, a drive shaft 3 that is rotated by the driving force of the engine section 2 and extends vertically, a forward/reverse changing mechanism 4 connected to a lower end of the drive shaft 3, a propeller shaft 5 that is connected to the forward/reverse changing mechanism 4 and extends horizontally, and a propeller 6 attached to a rear end portion of the propeller shaft 5. The engine section 2 is housed in a cowling 7. In an upper case 8 and a lower case 9 arranged below the cowling 7, the drive shaft 3, the forward/reverse changing mechanism 4, and the propeller shaft 5 are housed. The outboard motor 1 is mounted to a transom plate 101 provided on a reverse direction (direction of an arrow "A") side of a hull 100 via a clamp bracket 10. The clamp bracket 10 supports the outboard motor 1 pivotally around a tilt shaft 10*a* in a vertical direction with respect to the hull 100. A fuel tank 102 arranged to contain fuel (gasoline) is provided on the hull 100. Note that the fuel tank 102 is an example of the "first fuel tank" according to a preferred embodiment of the present invention. The fuel tank 102 and the engine section 2 of the outboard motor 1 are connected by a fuel pipe (not shown). The engine section 2 of the outboard motor 1 is driven by using fuel supplied from the fuel tank 102. The propeller 6 is rotated by the driving force of the engine section 2, and a rotational direction of the propeller 6 is changed by the forward/reverse changing mechanism 4. Thus, the hull 100 is propelled in a forward direction (direction of an arrow "B") or in a reverse direction (direction of the arrow "A"). A vent 7*a* is provided on a reverse direction (direction of the arrow "A") side of the cowling 7. Air supplied to the engine section 2 is taken into the engine section 2 in the cowling 7 via the vent 7*a*.

As shown in FIGS. 2 to 5, the engine section 2 includes an engine 20, an intake system 30 arranged to supply air to the engine 20, a fuel system 40 arranged to supply fuel to the engine 20, and an ECU (Engine Control Unit) 50 (see FIG. 14).

Figure 2:
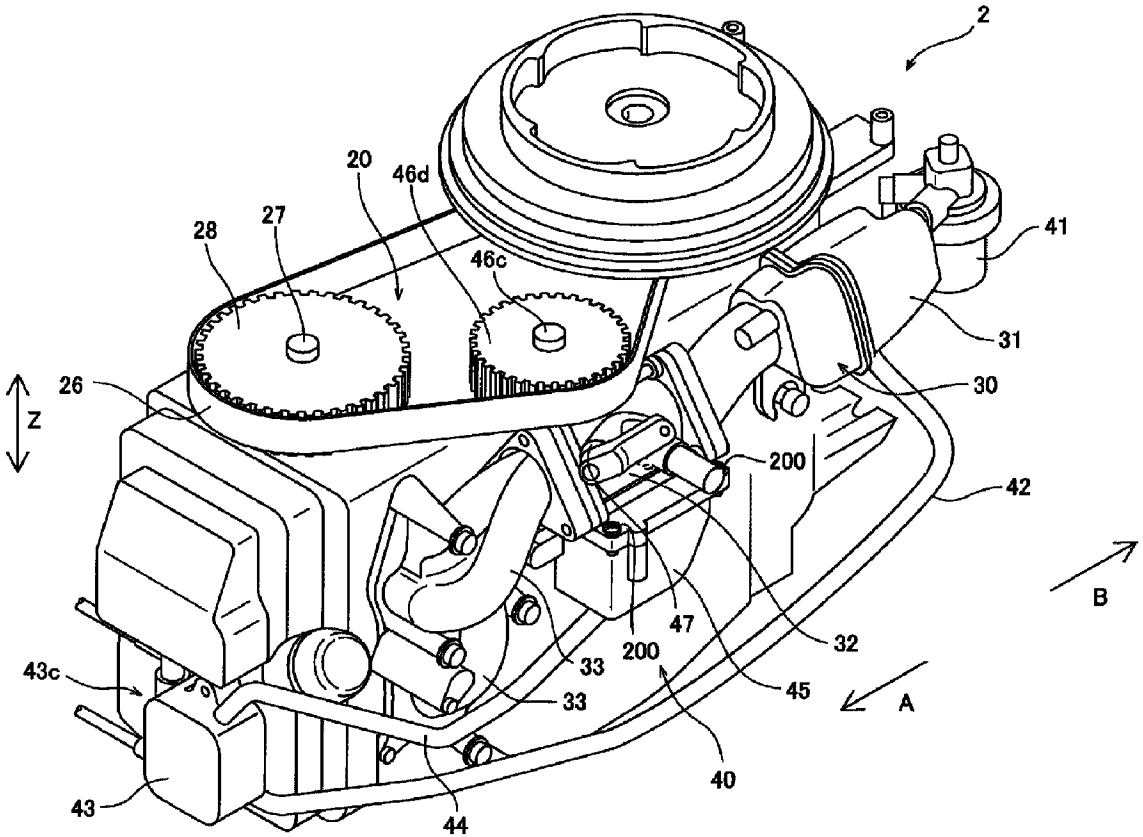
FIG. 2 is a perspective view showing an engine section of the outboard motor shown in FIG. 1.
Figure 3:
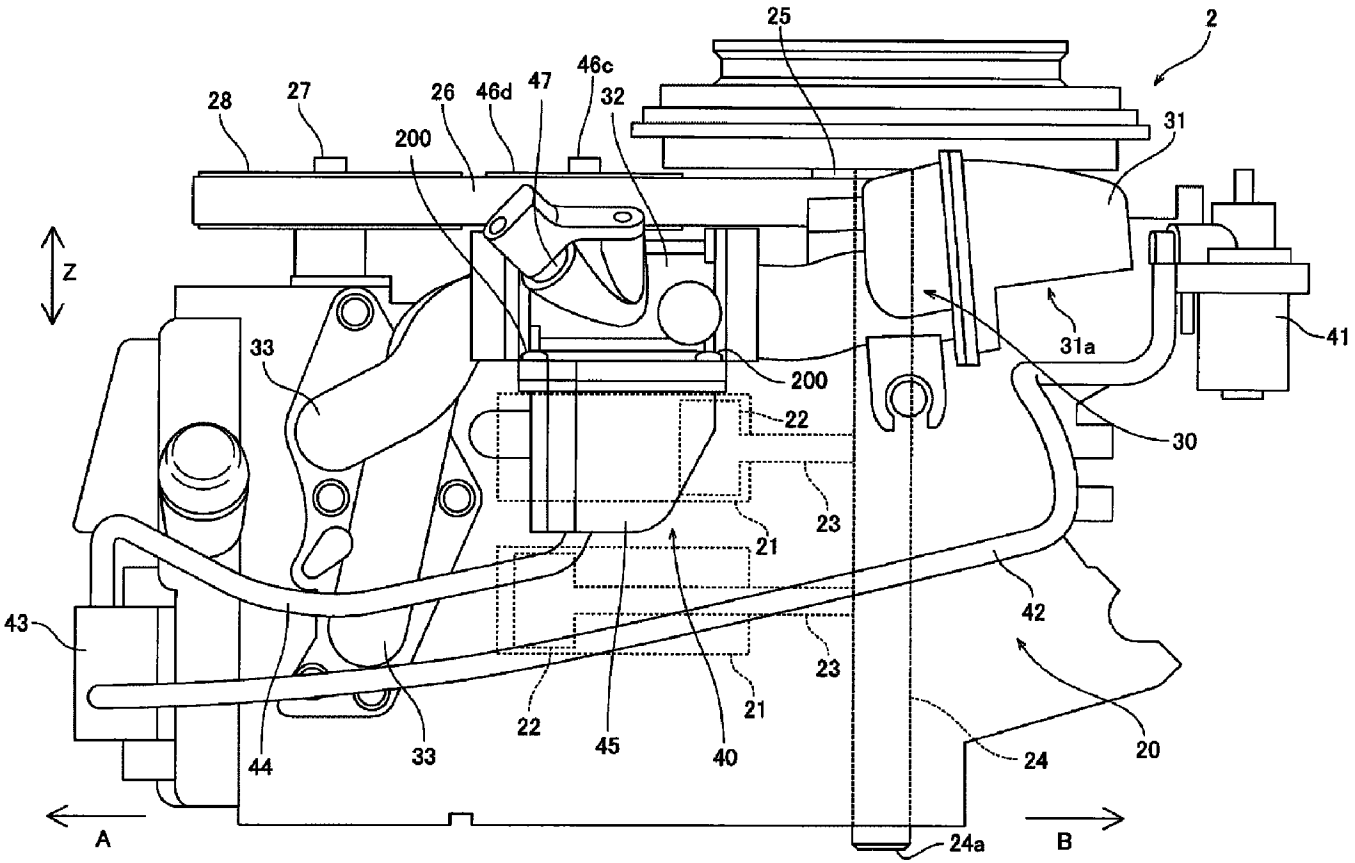
FIG. 3 is a side view showing the engine section of the outboard motor shown in FIG. 1.
Figure 4:
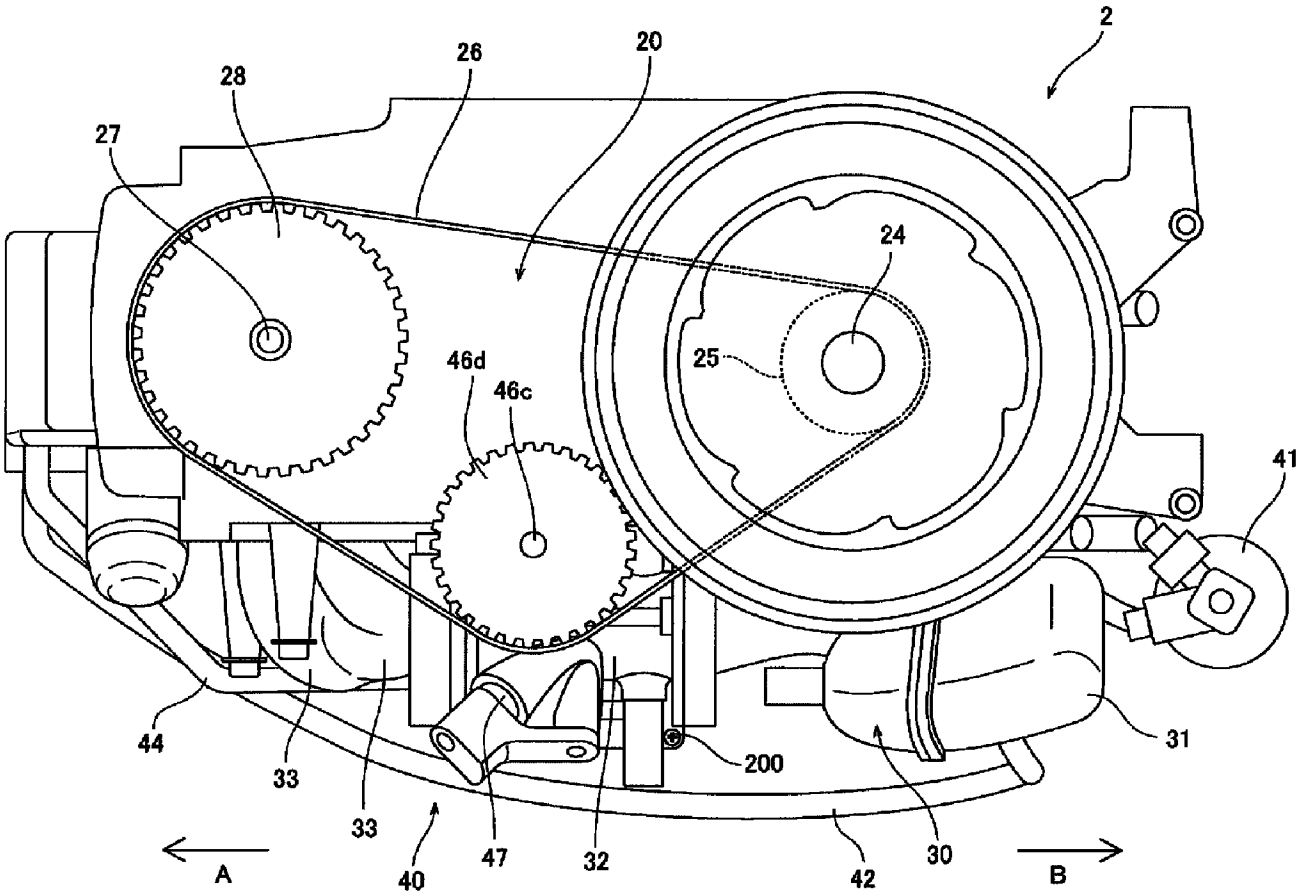
FIG. 4 is a top view showing the engine section of the outboard motor shown in FIG. 1.

As shown in FIG. 3, the engine 20 includes two cylinders 21 that are disposed parallel or substantially parallel to a vertical direction ("Z" direction) and two pistons 22 that reciprocate horizontally in each of the cylinders 21. Each of the pistons 22 is connected to a crankshaft 24 extending in the vertical direction ("Z" direction) via a connecting rod 23. The horizontal reciprocating motion of the piston 22 is converted to the rotational motion by the connecting rod 23 and the crankshaft 24. A lower end portion 24*a* of the crankshaft 24 is connected to the drive shaft 3 (see FIG. 1). As shown in FIGS. 2 to 5, rotation of the crankshaft 24 is transmitted to a camshaft 27 by a pulley 25 fixed at the top of the crankshaft 24, a belt 26, and a pulley 28 fixed to the camshaft 27. An intake valve (not shown) and an exhaust valve (not shown) of each of the cylinders 21 are driven at predetermined timings by the rotation of the camshaft 27.

Figure 5:
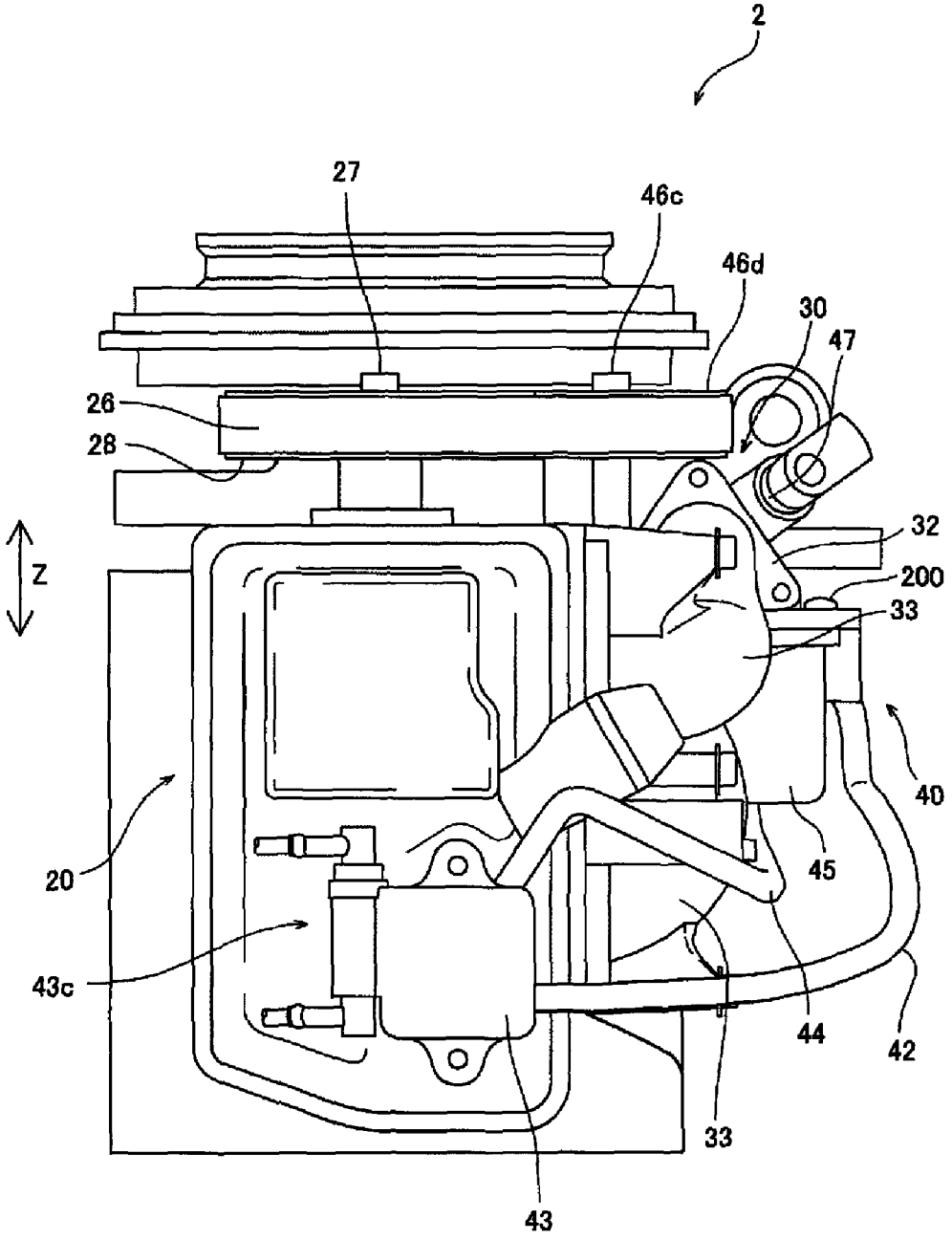
FIG. 5 is a front view showing the engine section of the outboard motor shown in FIG. 1.

As shown in FIGS. 2 and 5, the intake system 30 is disposed on the right of the engine 20 when seen from a forward direction (direction of the arrow "B") of the engine 20. The intake system 30 includes a silencer case 31 that is disposed in a forward direction (direction of the arrow "B") side and has an inlet 31*a* (see FIG. 3), a throttle body 32 connected to the silencer case 31, and two intake pipes 33 connected to an intake port (not shown) of each of the cylinders 21.

As shown in FIGS. 6 to 8 and FIG. 14, the throttle body 32 is preferably made of resin or metal and has a cylindrical air passage 32*a*. A butterfly-type throttle valve 32*b* (see FIG. 8) is provided in the air passage 32*a*. As shown in FIG. 14, a bypass air passage 32*c* that connects an upstream side and a downstream side of the air passage 32*a* relative to the throttle valve 32*b* is provided in the throttle body 32. The bypass air passage 32*c* provides an air flow rate at idling when the throttle valve 32*b* is completely closed. Also, in the bypass air passage 32*c*, an ISC (Idle Speed Control) unit 34 that has a valve to control the air flow rate in the bypass air passage 32*c* is provided. The engine speed during idling can be controlled by adjusting the opening degree of the valve of the ISC unit 34. The throttle body 32 also has a throttle opening sensor 35 arranged to detect the opening degree of the throttle valve 32*b*, an intake air pressure sensor 36 arranged to detect air pressure in the air passage 32*a*, and an intake air temperature sensor 37 arranged to detect the air temperature in the air passage 32*a*. The ISC unit 34 and a sensor section 38 including the throttle opening sensor 35, the intake air pressure sensor 36, and the intake air temperature sensor 37 are attached to an upper portion of the throttle body 32.

As shown in FIGS. 2 to 6 and FIG. 14, the fuel system 40 includes a filter 41 connected to the fuel tank 102 disposed on the hull 100, a low-pressure fuel pump 43 connected to the filter 41 via a fuel pipe 42 preferablymade of rubber or resin (or any other suitable flexible polymeric or elastomeric material), a vapor separator tank 45 connected to the low-pressure fuel pump 43 via a fuel pipe 44 made of rubber or resin(or any other suitable flexible polymeric or elastomeric material), a high-pressure fuel pump 46 (see FIG. 6) for supplying fuel contained in the vapor separator tank 45, and an injector 47 arranged to inject the fuel supplied by the high-pressure fuel pump 46. Note that the low-pressure fuel pump 43, the vapor separator tank 45, the high-pressure fuel pump 46, and the injector 47 are respectively, examples of the "fuel transport pump," the "second fuel tank," the "fuel supply pump," and the "fuel injection device" according to a preferred embodiment of the present invention.

Figure 12:
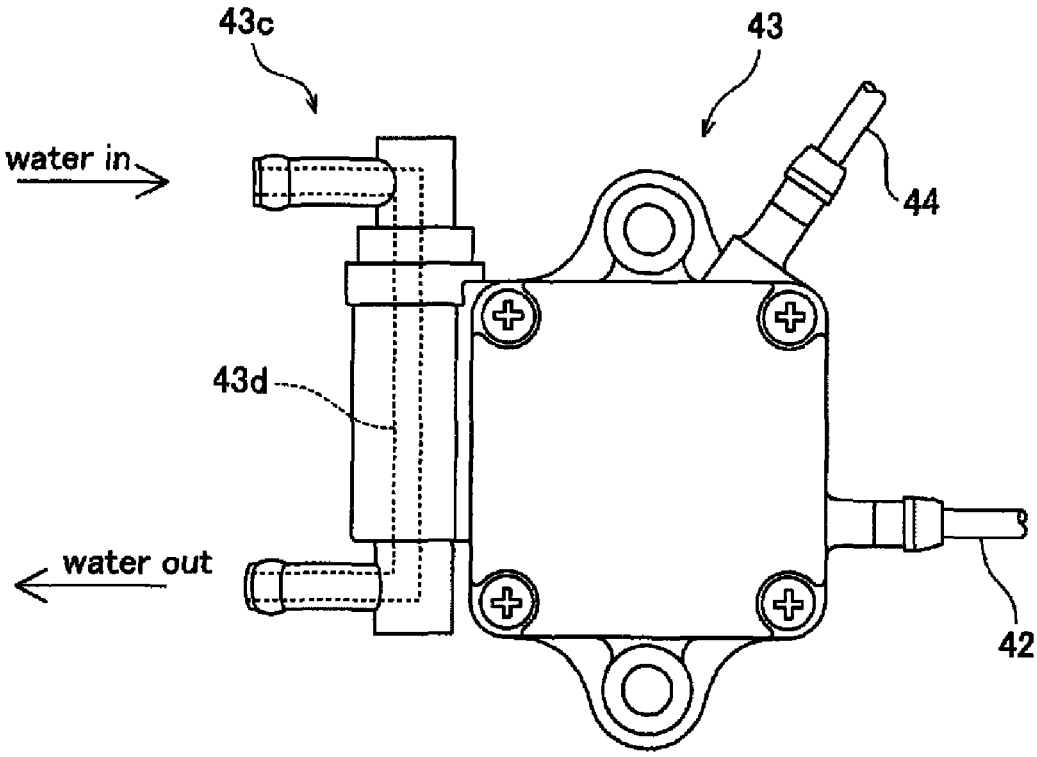
FIG. 12 is a front view showing a low-pressure fuel pump in the engine section of the outboard motor shown in FIG. 1.
Figure 13:
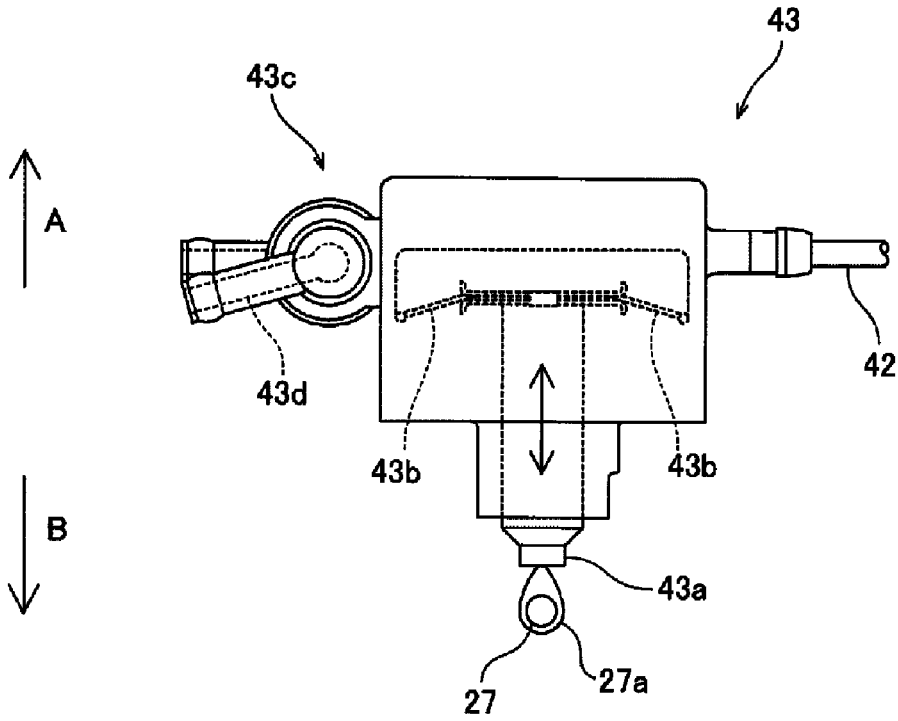
FIG. 13 is a bottom view showing the low-pressure fuel pump in the engine section of the outboard motor shown in FIG. 1.
Figure 14:
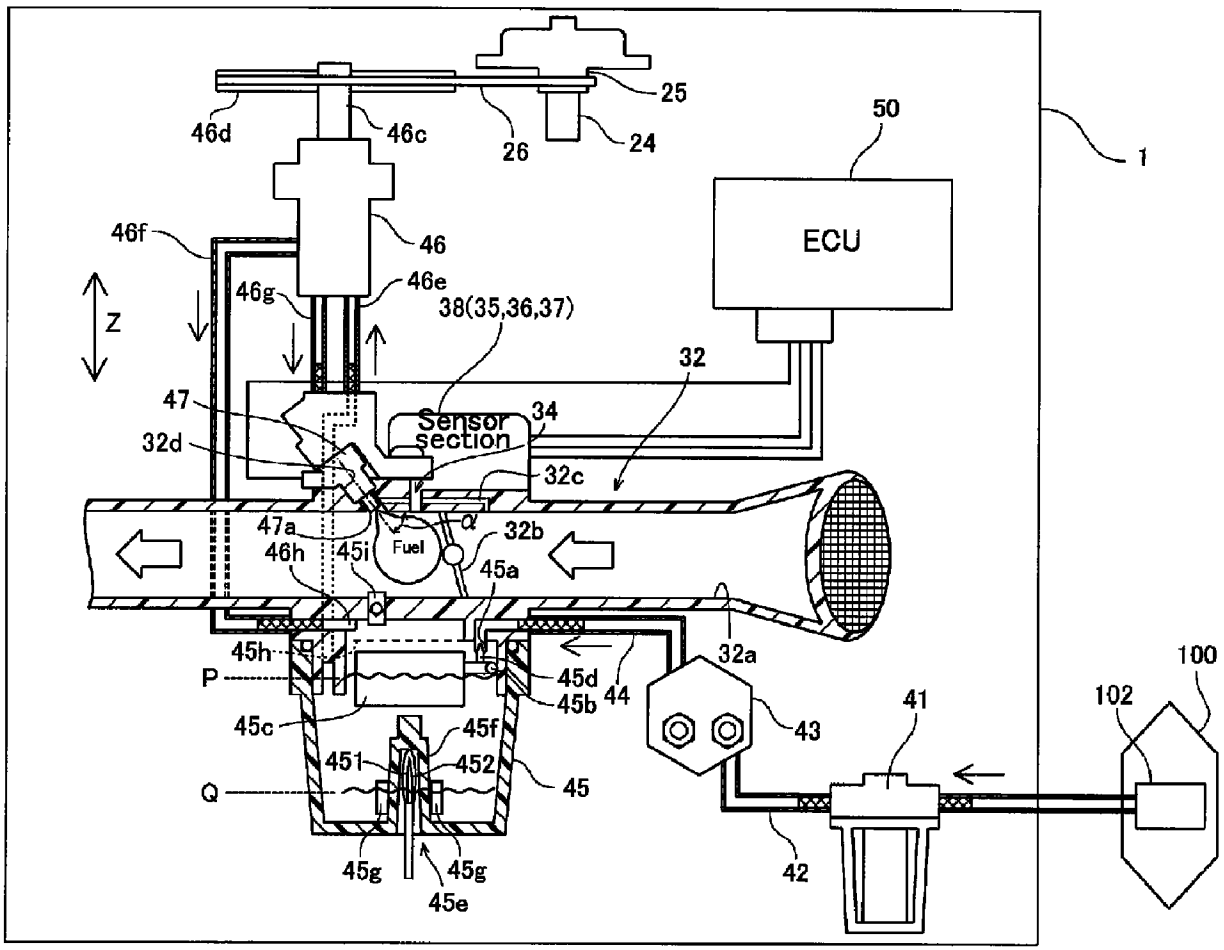
FIG. 14 is a schematic view showing a fuel supply system of the outboard motor in FIG. 1.

As shown in FIG. 13, the low-pressure fuel pump 43 is preferably a so-called diaphragm type fuel pump including a piston 43*a* and a diaphragm 43*b*. The piston 43*a* of the low-pressure fuel pump 43 is configured to reciprocate in conjunction with rotation of a cam 27*a* attached to the camshaft 27 of the engine 20 (see FIG. 2). The diaphragm 43*b* is configured to reciprocate corresponding to the reciprocation of the piston 43*a*, thereby transporting fuel. As shown in FIGS. 12 and 13, a water-cooling section 43*c* is provided on a side portion of the low-pressure fuel pump 43. The water-cooling section 43*c* has a pipe 43*d* extending along the side portion of the low-pressure fuel pump 43 and allows the pipe 43*d* to pass water, thereby cooling the low-pressure fuel pump 43. Note that the water-cooling section 43*c* is an example of the "third cooling section" according to a preferred embodiment of the present invention. Since the fuel that is pumped up from the fuel tank 102 on the hull 100 by the low-pressure fuel pump 43 passes through the filter 41, foreign matter and the like contained in the fuel are eliminated.

Figure 6:
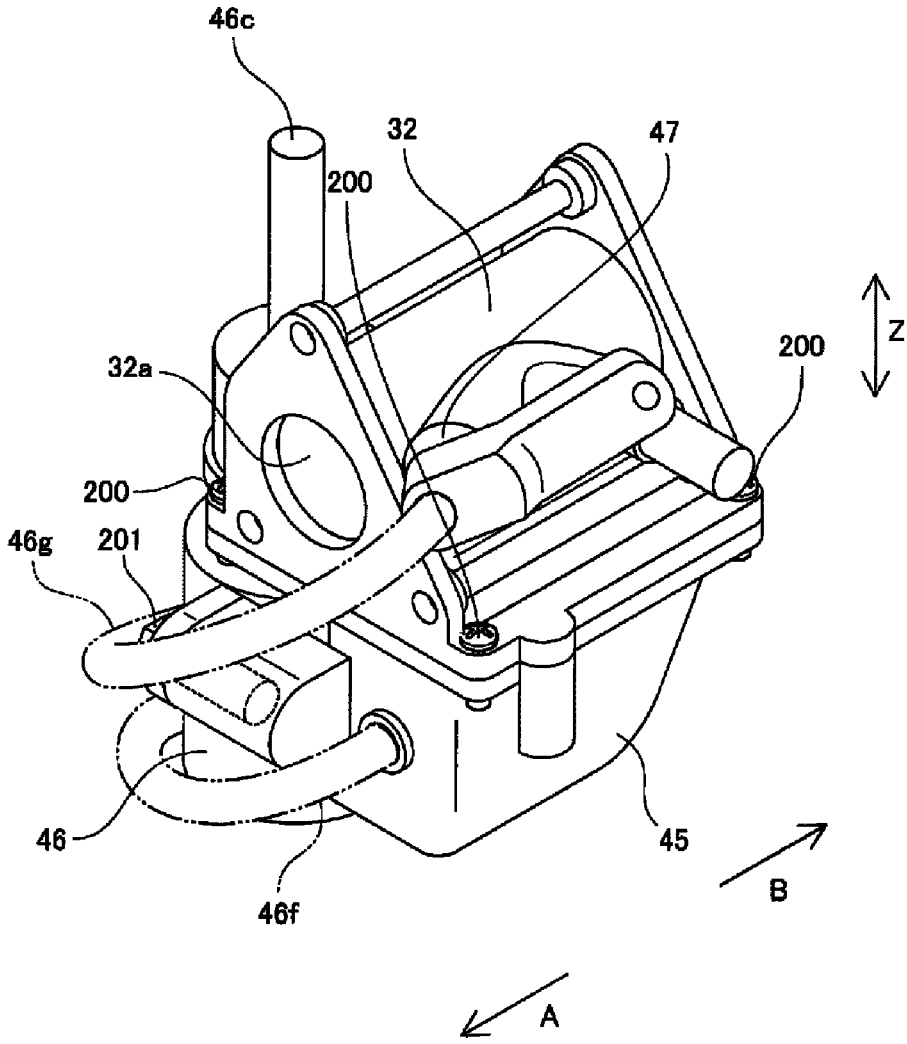
FIG. 6 is a perspective view showing a throttle body and its vicinity in the engine section of the outboard motor shown in FIG. 1.
Figure 7:
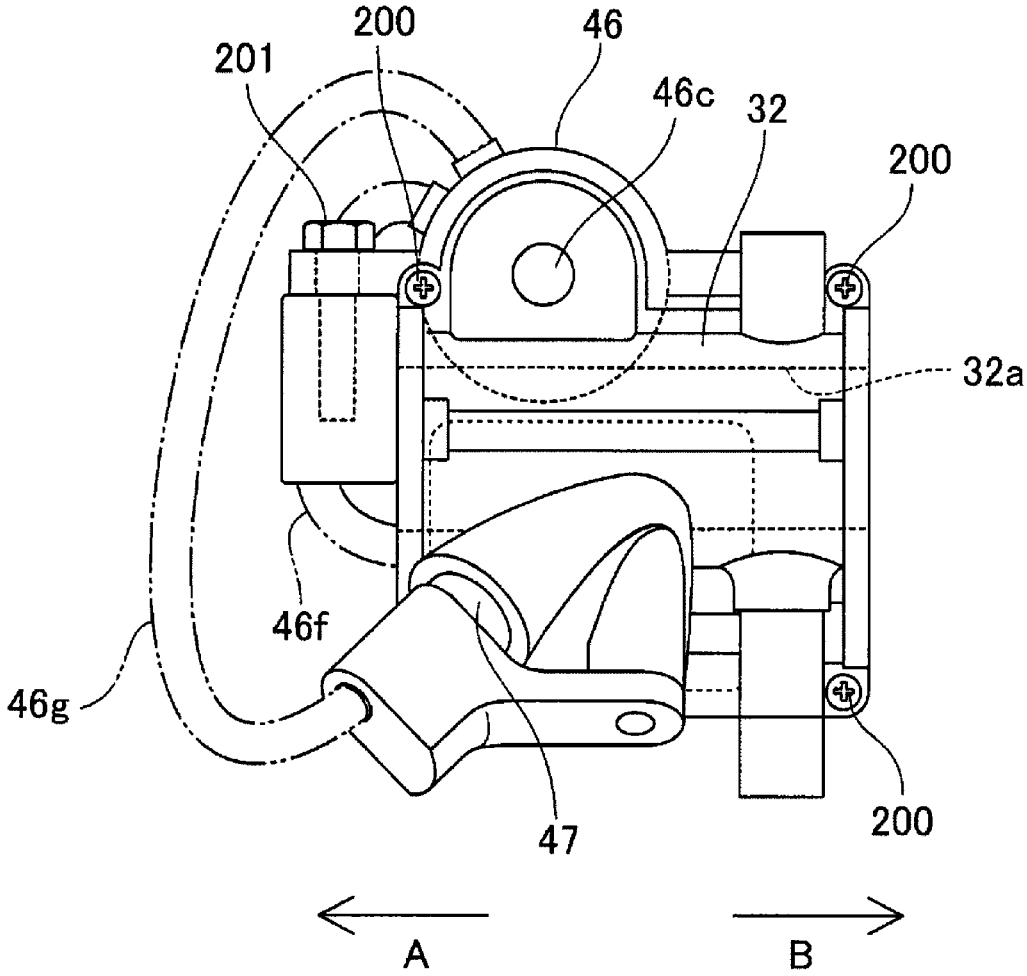
FIG. 7 is a top view showing the throttle body and its vicinity in the engine section of the outboard motor shown in FIG. 1.
Figure 8:
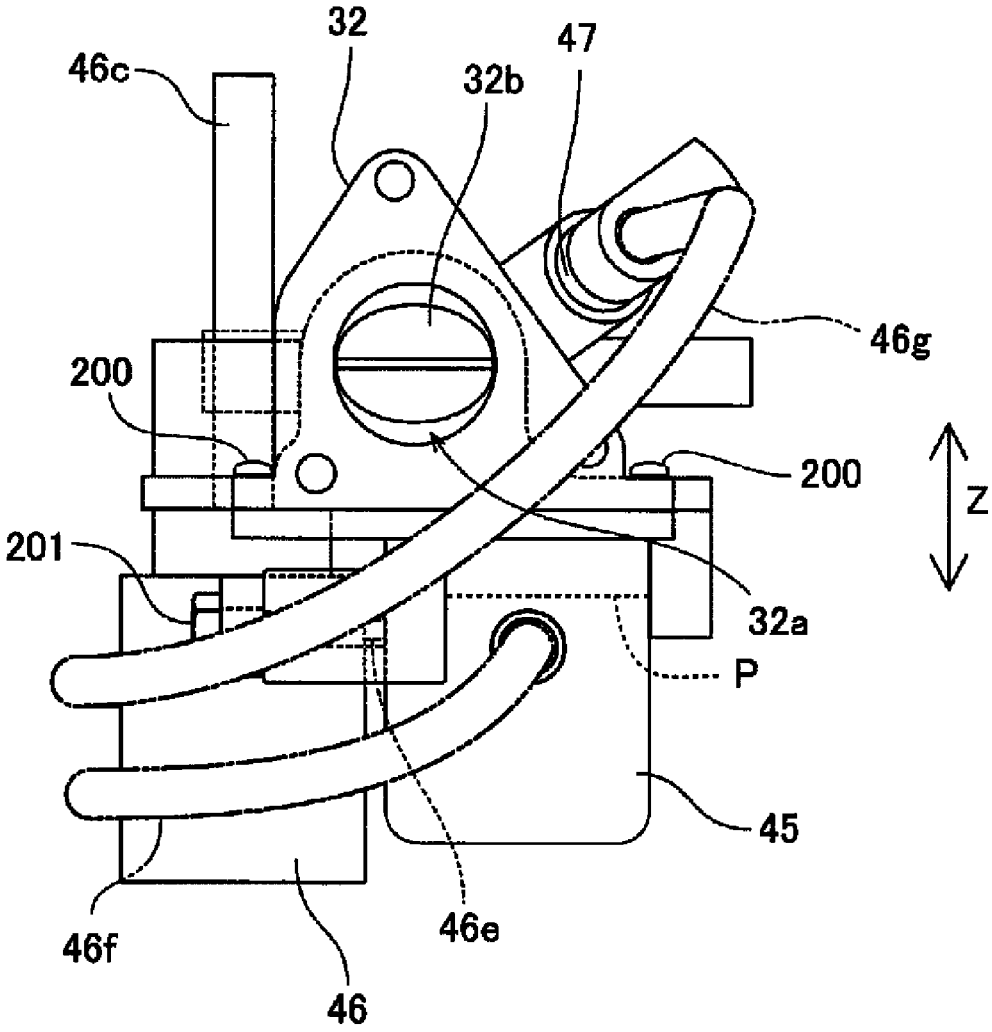
FIG. 8 is a front view showing the throttle body and its vicinity in the engine section of the outboard motor shown in FIG. 1.

The fuel sent out by the low-pressure fuel pump 43 is discharged from an outlet 45*a* (see FIG. 14) via the fuel pipe 44 and is contained in the vapor separator tank 45. The vapor separator tank 45 is preferably made of resin and disposed adjacent to and below the throttle body 32 to contact with the throttle body 32. In this preferred embodiment, as shown in FIGS. 6 to 8, the throttle body 32 and the vapor separator tank 45 are fixedly joined preferably by four screws 200, for example.

The vapor separator tank 45 contains the fuel pumped up from the fuel tank 102 and separates the vaporized fuel (vapor) or air from the liquid fuel. As shown in FIG. 14, the vapor separator tank 45 is configured such that the quantity of the fuel contained in the tank is kept constant and the fuel in the tank is kept at a predetermined level "P." Specifically, a float 45*c* that is pivotable about a pivot shaft 45*b* in the vertical direction ("Z" direction) is provided in the vapor separator tank 45. A needle valve 45*d* is provided in the float 45*c* at a position corresponding to the outlet 45*a*. Since the float 45*c* moves in the vertical direction as the fuel level in the vapor separator tank 45 moves, the needle valve 45*d* moves in the vertical direction corresponding to the movement of the float 45*c*. When the fuel level in the vapor separator tank 45 becomes higher than the predetermined level "P," the float 45*c* rises to insert the needle valve 45*d* in the outlet 45*a*, thereby automatically stopping inflow of fuel into the vapor separator tank 45. When the fuel level in the vapor separator tank 45 is lower than the predetermined level "P," the float 45*c* descends to separate the needle valve 45*d* from the outlet 45*a*, thereby automatically allowing an inflow of fuel into the vapor separator tank 45. With the above described mechanism, the quantity of the fuel contained in the vapor separator tank 45 is kept constant, and the fuel in the tank is kept at the predetermined level "P."

At the bottom of the vapor separator tank 45, there is provided a water sensor 45*e* to detect water collected at the bottom of the vapor separator tank 45. Specifically, a central portion 45*f* of the bottom of the vapor separator tank 45 protrudes upward. The protruded portion defines a recess as seen from the outside below the vapor separator tank 45. Two leads 451, 452 are disposed in the recess, and tips of the leads 451, 452 are connected to each other. Also, a pair of floats 45*g* that are floatable in water are provided at the bottom of the vapor separator tank 45. Each of the paired floats 45*g* has a built-in magnet (not shown). When water is collected at the bottom of the vapor separator tank 45, the float 45*g* having a magnet rises as a water level "Q" rises. When the floats 45*g* rises up to a predetermined position, the tip of the lead 451 and the tip of the lead 452 are separated from each other by magnetic force of the magnets. Accordingly, the connection between the leads 451, 452 is broken. With water sensor 45*e* configured as above, it is possible to detect whether or not water is collected in an equal or more quantity than a predetermined quantity at the bottom of the vapor separator tank 45.

A leading end 46*h* of a pipe 46*f* is inserted in an upper portion of the vapor separator tank 45. The pipe 46*f* is connected to the high-pressure fuel pump 46, which will be described below. The fuel returned from the high-pressure fuel pump 46 is discharged from the leading end 46*h* of the pipe 46*f* into the vapor separator tank 45. A buffer plate 45*h* is disposed below the leading end 46*h* of the pipe 46*f* and above the float 45*c* in the vapor separator tank 45. A plurality of small holes are provided in the buffer plate 45*h*. Fuel that is discharged from the leading end 46*h* of the pipe 46*f* is reserved again in the vapor separator tank 45 via the holes of the buffer plate 45*h*. When the fuel discharged from the leading end 46*h* of the pipe 46*f* bubbles, the buffer plate 45*h* can drip the liquid fuel into the vapor separator tank 45 without dropping bubbles.

The vapor separator tank 45 and the throttle body 32 are connected via a check valve 45*i*. The check valve 45*i* is configured to pass vapor (vaporized fuel) or air only in one direction from the vapor separator tank 45 to the throttle body 32. When vapor occurs, and thus internal pressure of the vapor separator tank 45 increases, the check valve 45*i* is opened by the pressure to discharge the vapor from the vapor separator tank 45 to the throttle body 32. Also, when the engine (engine section 2) is operated, the negative pressure in the throttle body 32 opens the check valve 45*i* to discharge the vapor from the vapor separator tank 45 to the throttle body 32.

Figure 9:
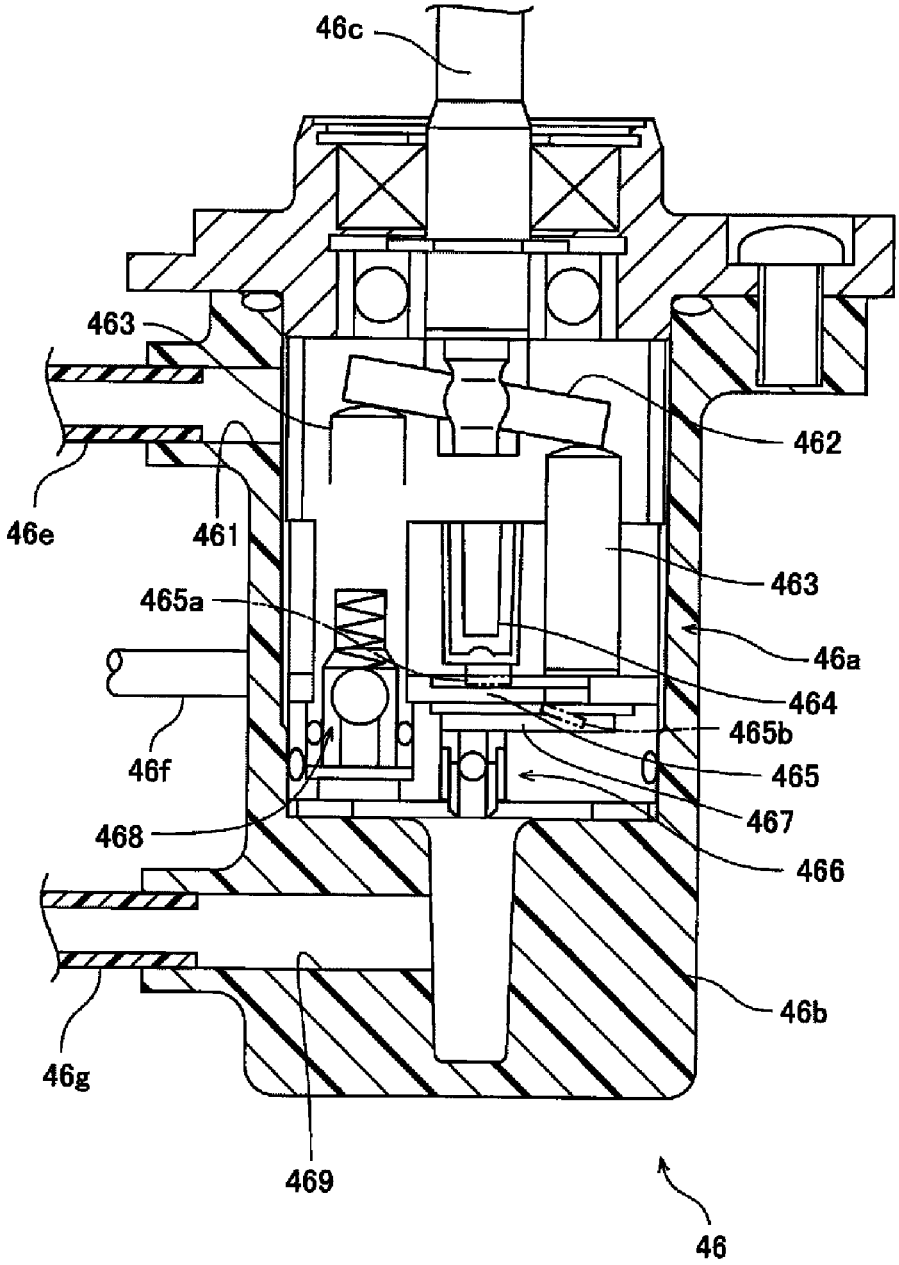
FIG. 9 is a partial sectional view showing the internal structure of a high-pressure fuel pump in the engine section of the outboard motor shown in FIG. 1.
Figure 10:
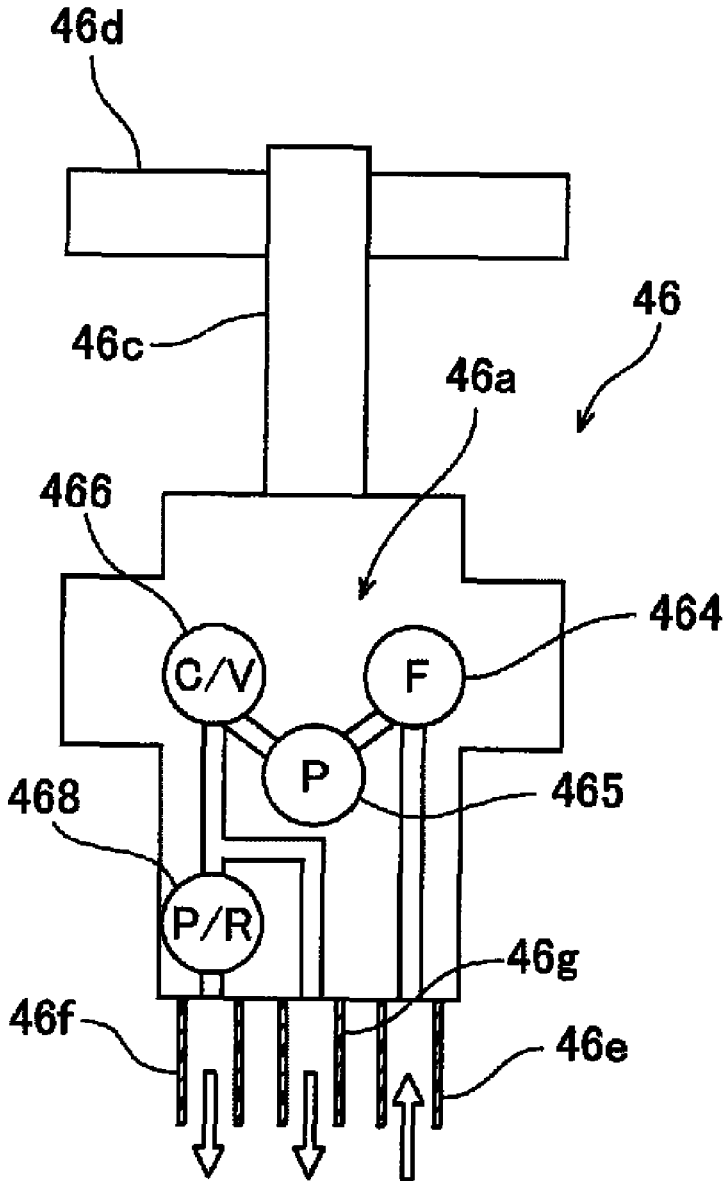
FIG. 10 is a schematic view showing the high-pressure fuel pump in the engine section of the outboard motor shown in FIG. 1.
Figure 11:
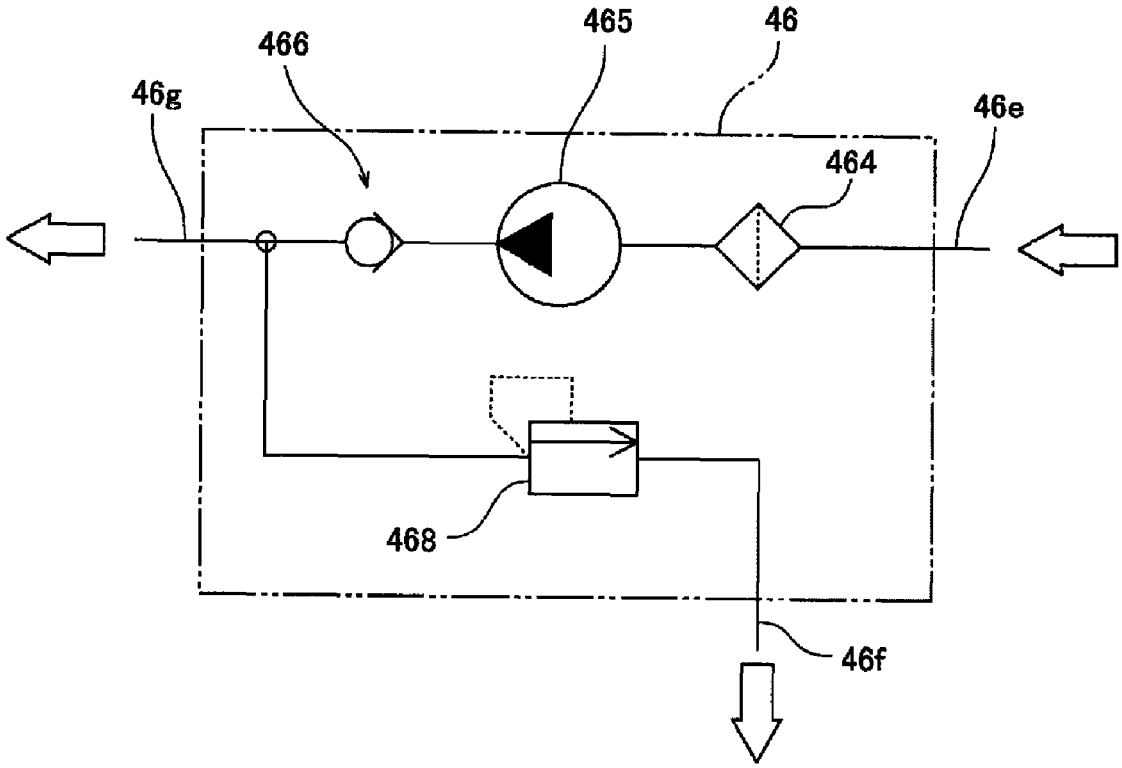
FIG. 11 is a hydraulic circuit diagram of the high-pressure fuel pump in the engine section of the outboard motor shown in FIG. 1.

As shown in FIGS. 6 to 8, the high-pressure fuel pump 46 is a so-called in-line fuel pump that is disposed outside the vapor separator tank 45 and interposed between the fuel pipes. The high-pressure fuel pump 46 is fixed to a side of the vapor separator tank 45 preferably by a screw 201, for example. The high-pressure fuel pump 46 is preferably made of resin as a base material. More specifically, as shown in FIG. 9, the high-pressure fuel pump 46 is configured such that a pump main portion 46*a* through which fuel passes is retained by an outer frame 46*b* preferably made of resin, for example. The pump main portion 46*a* is configured to transport fuel by rotating a rotary shaft 46*c*. In this preferred embodiment, as shown in FIGS. 2 to 5, a pulley 46*d* is fixed at an upper end of the rotary shaft 46*c*. The pulley 46*d* meshes with the belt 26 together with the pulley 25 of the crankshaft 24 and the pulley 28 of the camshaft 27. Thus, as the crankshaft 24 is rotated by the driving force of the engine, the pulley 46*d* and the rotary shaft 46*c* are rotated to drive the pump main portion 46*a*. Note that the pulley 46*d* is an example of the "pump driving section" according to a preferred embodiment of the present invention.

As shown in FIG. 9, the pump main portion 46*a* includes an inlet 461 connected to the vapor separator tank 45 via a resin pipe 46*e*, a swash plate 462 fixed aslant to the rotary shaft 46*c*, a plunger 463, a filter 464, a reserving chamber 465 arranged to temporarily contain fuel, a reserving chamber 467 containing a fuel pressure retaining valve 466, a relief valve 468 connected to the vapor separator tank 45 via a resin pipe 46*f*, and an outlet 469 connected to the injector 47 (see FIG. 14) via a resin pipe 46*g*. The inlet 461, the filter 464, the reserving chamber 465, the reserving chamber 467, the relief valve 468, and the outlet 469 define an example of the "fuel path" according to a preferred embodiment of the present invention. An upper end of the plunger 463 abuts a lower surface of the swash plate 462. As the swash plate 462 rotates with the rotary shaft 46*c*, the plunger 463 reciprocates in a vertical direction. When the plunger 463 moves upward, fuel is drawn from the vapor separator tank 45 into the reserving chamber 465 via the inlet 461 and the filter 464. When the plunger 463 moves downward, fuel is pushed out from the reserving chamber 465 to the reserving chamber 467. There are provided a lead valve 465a and a lead valve 465*b*, respectively, between the filter 464 and the reserving chamber 465 and between the reserving chamber 465 and the reserving chamber 467. These valves open when fuel flows in a transport direction (direction from the inlet 461 to the outlet 469) and close when fuel attempts to flow in the opposite direction. When fuel is drawn from the filter 464 into the reserving chamber 465, the lead valve 465a opens and the lead valve 465*b* closes at the same time as the plunger 463 moves upward. When fuel is pushed out from the reserving chamber 465 to the reserving chamber 467, the lead valve 465*a* closes and the lead valve 465*b*opens at the same time as the plunger 463 moves downward. When the pressure of the fuel contained in the reserving chamber 467 becomes equal to or larger than a predetermined value, the fuel is discharged from the outlet 469 via the fuel pressure retaining valve 466. The outlet 469 is connected to the relief valve 468. When pressure at the outlet 469 increases excessively when the injector 47 (see FIG. 14) is plugged with fuel, for example, fuel is discharged into the vapor separator tank 45 (see FIG. 14) via the relief valve 468 and the pipe 46*f*.

As shown in FIG. 14, the injector 47 has a function to inject the fuel that is provided at a predetermined pressure from the high-pressure fuel pump 46 at predetermined timing. In this preferred embodiment, the injector 47 is mounted in a mounting hole 32*d* of the throttle body 32. The injector 47 is configured to inject fuel in a direction opposite to an airflow direction in the air passage 32*a* of the throttle body 32. The direction of the fuel injection is tilted at an angle of at (about 20 to about 60 degrees, for example) relative to the airflow direction. Fuel injection in the opposite direction to the airflow direction allows the injected fuel to be atomized and spread evenly throughout the air passage 32*a* and prevents the fuel from attaching to an inner surface of the air passage 32*a*. An injection nozzle 47*a* of the injector 47 is disposed in a downstream vicinity of the throttle valve 32*b*. Fuel is injected from the injection nozzle 47*a* of the injector 47 toward the throttle valve 32*b*. Also, the injection nozzle 47*a* of the injector 47 is positioned at an exit of the bypass air passage 32*c*. Thus, fuel is injected into a faster portion of the airflow. This facilitates fuel atomization. In this preferred embodiment, with the above configuration, fuel can be distributed evenly to the two intake pipes 33 by the single injector 47.

Figure 15:
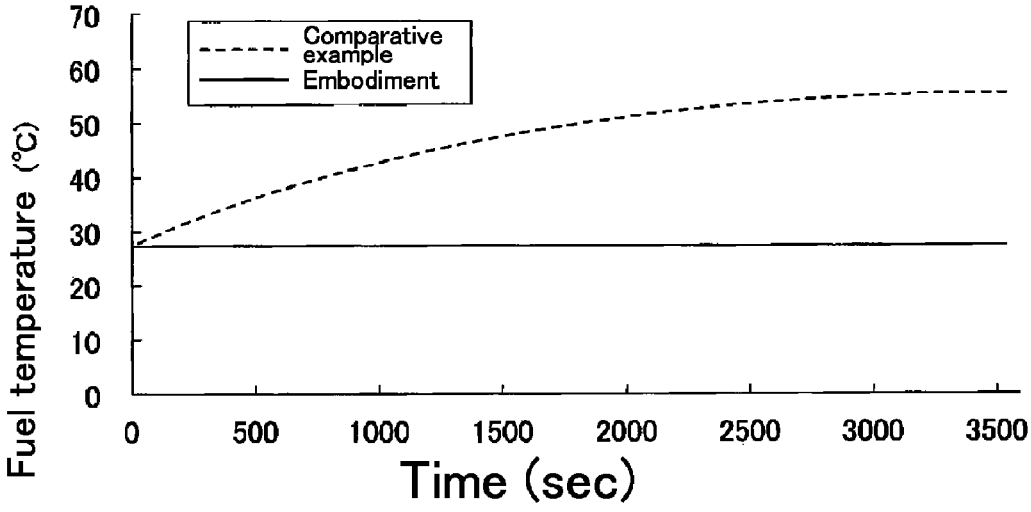
FIG. 15 is a graph showing the result of comparative experiments to verify the benefits and advantages of preferred embodiments of the present invention.

FIG. 15 is a graph showing the result of comparative experiments to verify the advantages and benefits of the preferred embodiments of the present invention. Now, with reference to FIG. 15, the comparative experiments will be described.

In the comparative experiments, temporal change of the fuel temperature in the vapor separator tank 45 is measured for the outboard motor 1 according to the preferred embodiment in which the pump main portion 46*a* of the fuel pump 46 is not driven by a motor but driven by the driving force of the engine. For comparison, temporal change of the fuel temperature in the vapor separator tank is measured for a conventional outboard using an in-tank fuel pump in which a fuel pump is driven by a motor and fuel passes through the inside of the motor of the fuel pump. FIG. 15 shows the result of the experiments. In FIG. 15, the abscissa axis represents the elapsed time from the starting of the engine, and the ordinate axis represents the fuel temperature in the vapor separator tank.

As shown in FIG. 15, in the comparative example, the fuel temperature is at room temperature (about 27 degrees C.) at the starting of the engine and increases up to about 55 degrees C. as the time elapses after the starting of the engine. In the outboard motor according to the comparative example, fuel passes through the inside of the motor. In this case, it is contemplated that the fuel temperature increases due to the situation that fuel is heated by the heat of the motor when the fuel is pumped up by the fuel pump. In contrast, in the present preferred embodiment, the fuel temperature is at room temperature (about 27 degrees C.) at the starting of the engine and does not change as the time elapses after the starting of the engine. It is contemplated that since a fuel pump driving section is driven by the driving force of the engine, the fuel pump driving section does not generate heat, and thus the fuel temperature is prevented from increasing. Also, even though the fuel pump driving section generates slight heat due to friction or the like, the pump main portion is spaced away from the fuel pump driving section, which can minimize an increase in the fuel temperature.

In the present preferred embodiment, as described above, the high-pressure fuel pump 46 includes the pump main portion 46*a* having a fuel path and the pulley 46*d* separated from the fuel path of the pump main portion 46*a*. This arrangement minimizes heat generation in the high-pressure fuel pump 46 when driving the pump main portion 46*a*, thereby minimizing an increase in the fuel temperature in the high-pressure fuel pump 46. Thus, it is possible to minimize the generation of vapor (vaporized fuel) in the vapor separator tank 45, thereby preventing fuel from vaporizing and returning to the fuel tank 102 mounted on the hull 100. Therefore, it is possible to minimize the reduction of fuel in the vapor separator tank 45. This allows the high-pressure fuel pump 46 to easily pump fuel up from the vapor separator tank 45 and supply fuel to the injector 47 during a restart of the engine. As a result, deterioration in engine startability can be minimized.

In this preferred embodiment, as described above, the high-pressure fuel pump 46 is preferably disposed outside the vapor separator tank 45. This allows the high-pressure fuel pump 46 to easily drive the pump main portion 46*a* using the driving force of the engine.

In this preferred embodiment, as described above, the pump main portion 46*a* is preferably driven by the driving force of the engine. This eliminates the necessity of an extra driving source such as a motor to drive the pump main portion 46*a*. Since the pump main portion 46*a* is driven by the driving force of the engine, the high-pressure fuel pump 46 can automatically supply a large amount fuel to the injector 47 by driving the pump main portion 46*a* at high speed corresponding to the high engine speed when the engine operates at high speed and needs a large amount of fuel. When the engine operates at low speed and needs less fuel, the high-pressure fuel pump 46 can automatically supply less fuel to the injector 47 by driving the pump main portion 46*a* at low speed corresponding to the low engine speed. Thus, the high-pressure fuel pump 46 can supply only the needed quantity of fuel to the injector 47. Therefore, it is possible to reduce fuel that returns to the vapor separator tank 45 through the relief valve 468 of the high-pressure fuel pump 46. Thus, even though the fuel temperature increases in the pump main portion 46*a*, the heated fuel does not return to the vapor separator tank 45. This further minimizes an increase in the fuel temperature in the vapor separator tank 45. As a result, generation of vapor in the vapor separator tank 45 can be further minimized.

In this preferred embodiment, as described above, the vapor separator tank 45 and the high-pressure fuel pump 46 are disposed away from the engine 20. That is, the vapor separator tank 45 and the high-pressure fuel pump 46 are not directly attached to the engine 20. This minimizes direct heat transmission from the engine 20 to the vapor separator tank 45 and the high-pressure fuel pump 46. Thus, the temperature increase in the vapor separator tank 45 and the high-pressure fuel pump 46 can be minimized, thereby minimizing the generation of vapor in the vapor separator tank 45 and the high-pressure fuel pump 46.

In this preferred embodiment, as described above, the relief valve 468 is provided in the high-pressure fuel pump 46 to release fuel from the pump main portion 46*a* side to the vapor separator tank 45 side when the pressure of the fuel supplied to the injector 47 is equal to or larger than the predetermined value. The relief valve 468 installed in the high-pressure fuel pump 46 thereby prevents the injector 47 and the high-pressure fuel pump 46 from being damaged by the excessive fuel pressure when the injector 47 is plugged with fuel, for example.

In this preferred embodiment, as described above, the relief valve 468 is connected to the vapor separator tank 45 via the pipe 46*f*. Therefore, when the fuel temperature increases, and vapor is generated in the pump main portion 46*a*, the vapor is returned to the vapor separator tank 45 where the vapor and the liquid fuel can be separated. This prevents vapor from collecting in the pump main portion 46*a* of the high-pressure fuel pump 46, thereby minimizing uncontrolled fuel supply to the injector 47 that is caused by the collected vapor in the pump main portion 46*a*.

In this preferred embodiment, as described above, the pump main portion 46*a* of the high-pressure fuel pump 46 is retained by the outer frame 46*b*. Thus, the outer frame 46*b* of the high-pressure fuel pump 46 can easily be made of resin, for example. In addition, the outer frame 46*b*, which is preferably made of resin with low thermal conductivity, can minimize an increase in the fuel temperature in the pump main portion 46*a* that is caused by the heat radiated from the engine 20. This easily minimizes the generation of vapor in the pump main portion 46*a*.

In this preferred embodiment, as described above, the vapor separator tank 45 can be easily made of resin, for example. The vapor separator tank 45, which is preferably made of resin with low thermal conductivity, can minimize an increase in the fuel temperature in the vapor separator tank 45 that is caused by the heat radiated from the engine 20. This easily minimizes the generation of vapor in the vapor separator tank 45.

In this preferred embodiment, as described above, the water-cooling section 43*c* is provided to cool fuel in the low-pressure fuel pump 43 with water. This effectively minimizes an increase in the fuel temperature in the low-pressure fuel pump 43 that is caused by the heat radiated from the engine 20 or direct heat transferred from the engine 20. This effectively minimizes the generation of vapor in the low-pressure fuel pump 43.

It should be understood that the preferred embodiments disclosed herein are illustrative in all respects and not restrictive. The scope of the present invention is intended to be defined not by the above description of the preferred embodiments but by the claims, and to include all equivalents and modifications of the claims.

Figure 16:
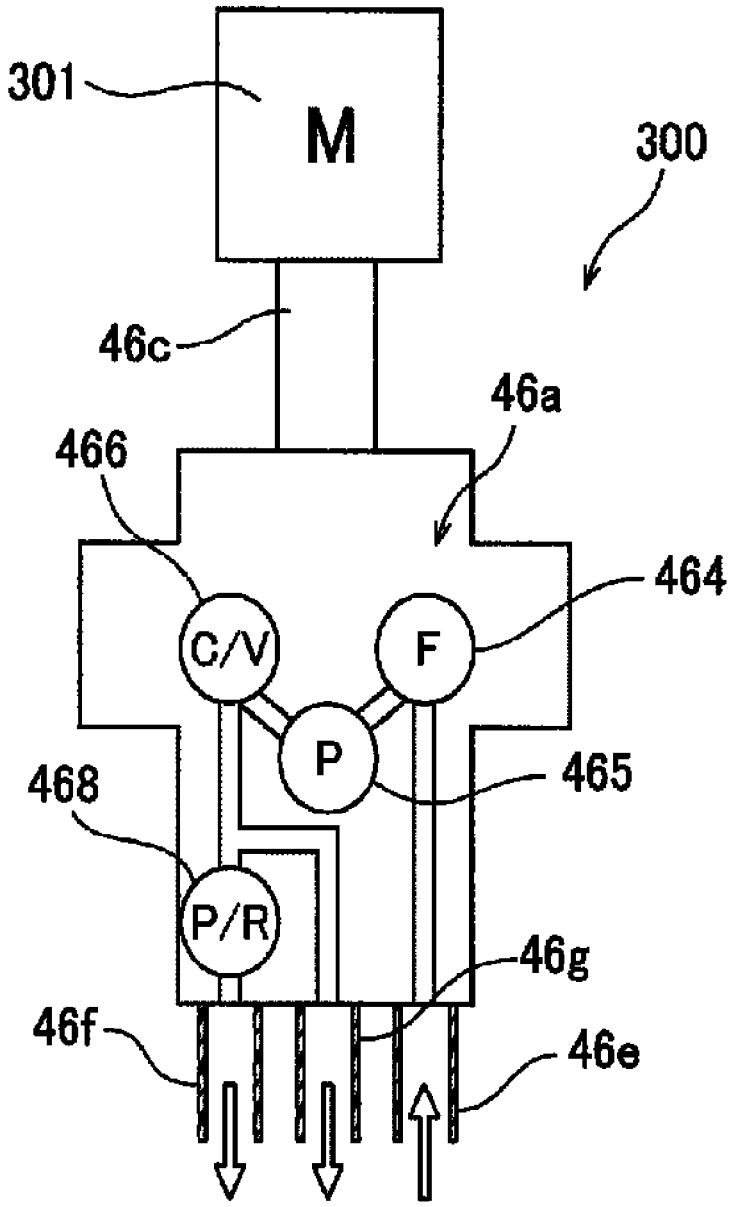
FIG. 16 is a schematic view showing a high-pressure fuel pump of an outboard motor according to a first variation of a preferred embodiment of the present invention.

For example, in the above preferred embodiments, the pulley 46*d* that is fixed to the rotary shaft 46*c* of the high-pressure fuel pump 46 is preferably meshed with the belt 26 for driving the camshaft 27 to drive the high-pressure fuel pump 46 by using the driving force of the engine 20. However, the present invention is not limited to this example. As in a high-pressure fuel pump 300 according to a first variation shown in FIG. 16, the high-pressure fuel pump 300 is preferably configured such that a rotary shaft thereof is rotated by the driving force of a motor 301 to drive the high-pressure fuel pump 300. Since fuel also does not pass through the inside of the motor 301 in this case, an increase in the fuel temperature caused by heat from the motor 301 can be minimized. Also, in the case where the hull 100 is stored for a long period, the high-pressure fuel pump 300 can prevent foreign matter and the like extracted from fuel from adhering to the inside of the motor 301. Thus, failure of the motor 301 can be minimized. Note that the motor 301 is an example of the "pump driving section" according to a preferred embodiment of the present invention.

In the above preferred embodiments, the rotary shaft 46*c* of the high-pressure fuel pump 46 is preferably rotated by the pulley 46*d* and the belt 26. However, the present invention is not limited thereto. The rotary shaft 46*c* may be rotated by transmitting rotation of the camshaft 27 to the rotary shaft 46*c* of the high-pressure fuel pump 46 by using a gear and the like.

In the above preferred embodiments, the high-pressure fuel pump 46 transports fuel preferably by driving the plunger 463 with the swash plate 462. However, the present invention is not limited thereto. Other types of high-pressure fuel pumps such as a vane-type pump, a screw-type pump, or a trochoid-type pump may be used.

Figure 17:
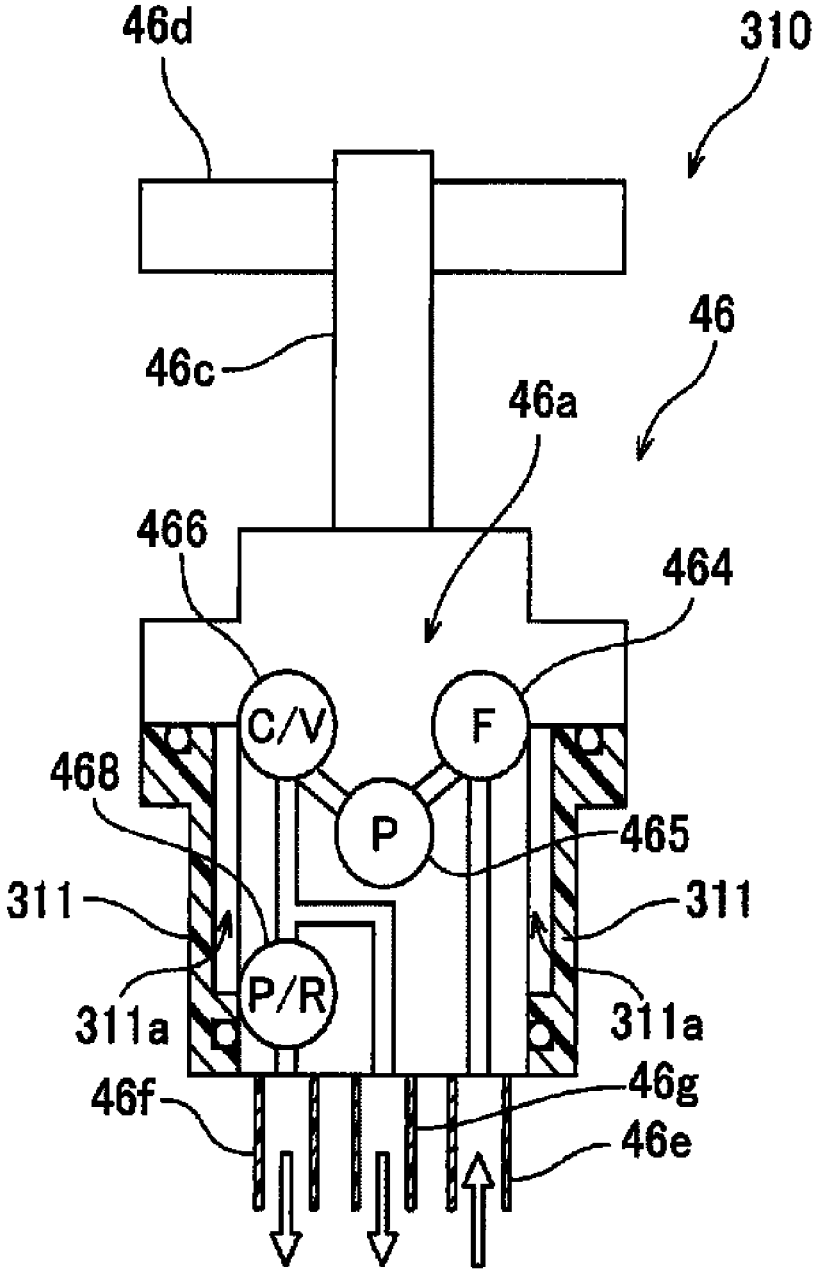
FIG. 17 is a schematic view showing a high-pressure fuel pump of an outboard motor according to a second variation of a preferred embodiment of the present invention.
Figure 18:
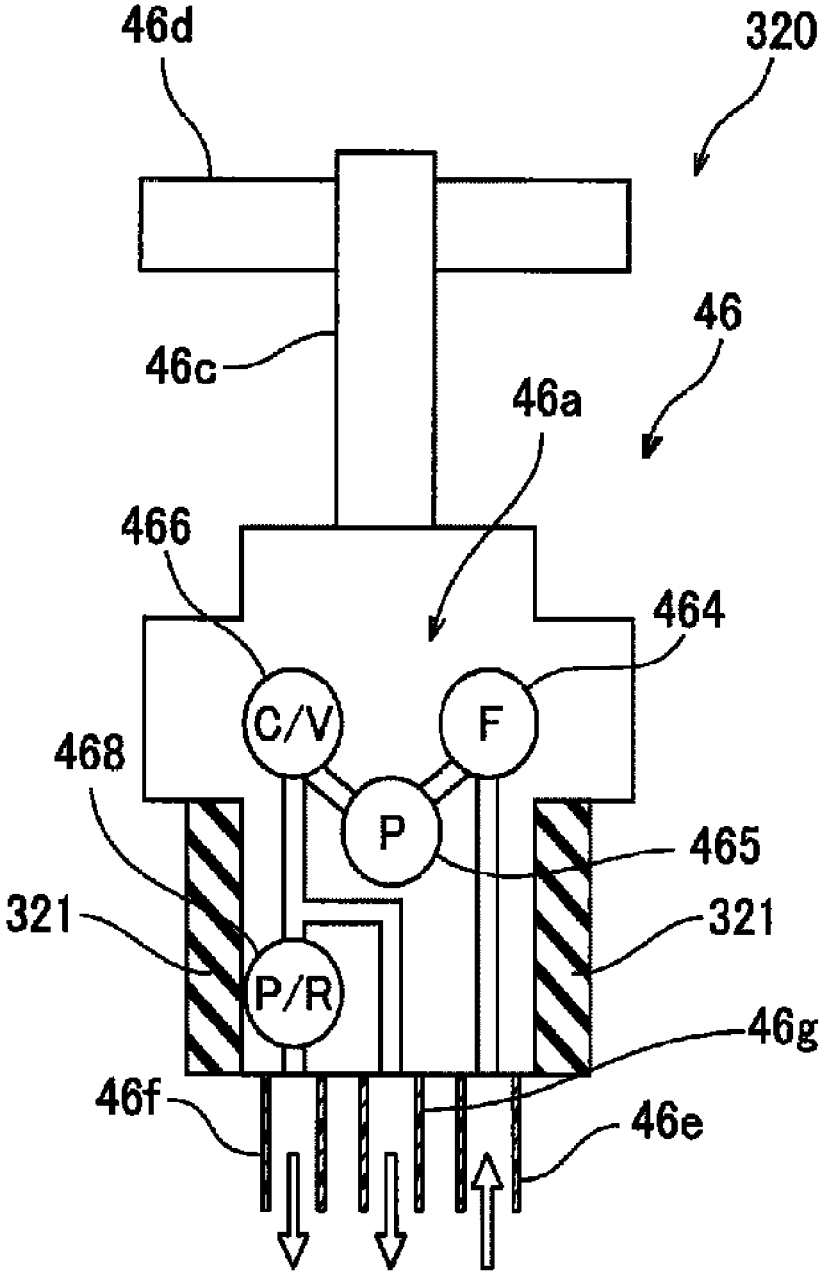
FIG. 18 is a schematic view showing a high-pressure fuel pump of an outboard motor according to a third variation of a preferred embodiment of the present invention.
Figure 19:
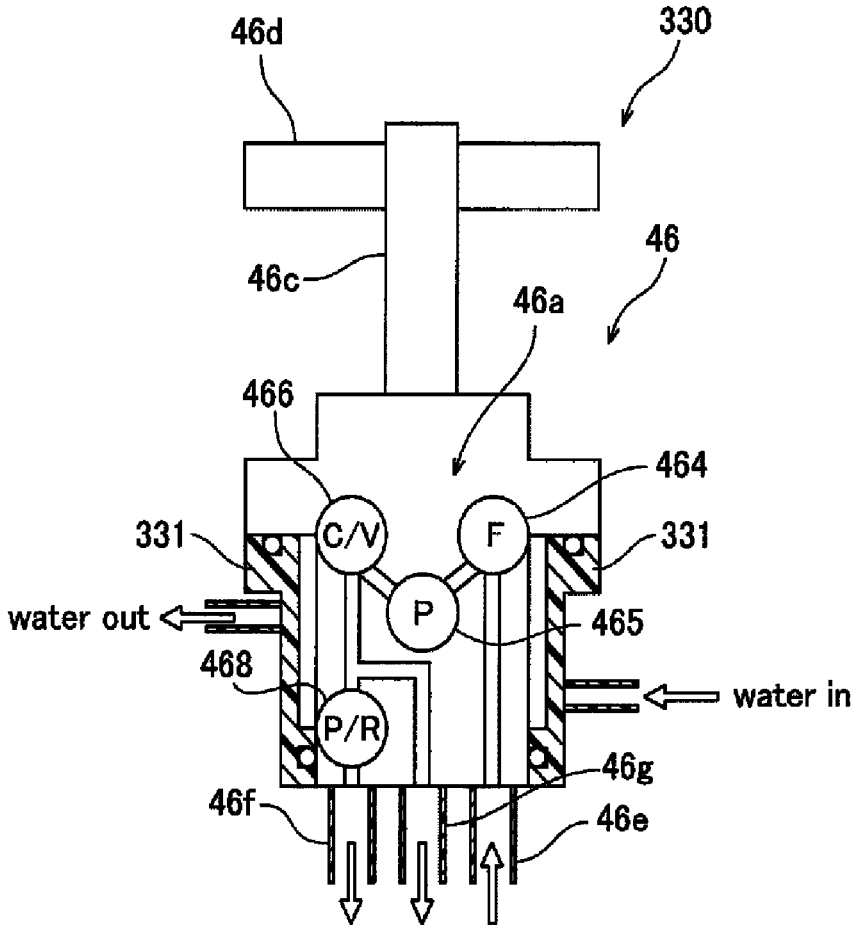
FIG. 19 is a schematic view showing a high-pressure fuel pump of an outboard motor according to a fourth variation of a preferred embodiment of the present invention.

In the above preferred embodiments, the high-pressure fuel pump 46 is preferably made of resin as a base material, thereby minimizing an increase in the fuel temperature in the pump main portion 46*a* that is caused by the heat radiated from the engine 20. However, the present invention is not limited thereto. As in a high-pressure fuel pump 310 according to a second variation shown in FIG. 17, an air containing member 311 that surrounds the pump main portion 46*a* may be provided to form an air layer 311*a* therebetween. Or, as in a high-pressure fuel pump 320 according to a third variation shown in FIG. 18, a heat insulator 321 may be provided outside of and surrounding the pump main portion 46*a*. The air layer 311*a* with low thermal conductivity or the heat insulator 321 thereby minimizes an increase in the fuel temperature in the pump main portion 46*a* that is caused by the heat radiated from the engine 20. Note that the air layer 311*a* and the heat insulator 321 are examples of the "heat insulating structure" according to a preferred embodiment of the present invention. Furthermore, as in a high-pressure fuel pump 330 according to a fourth variation shown in FIG. 19, a water jacket 331 may be provided outside of the pump main portion 46*a* to cool the pump main portion 46*a* with seawater. The pump main portion 46*a* can be cooled by the seawater that passes through the water jacket 331, and thus the fuel in the pump main portion 46*a* can be cooled. Therefore, it is possible to minimize an increase in the fuel temperature in the pump main portion 46*a* that is caused by the heat radiated from the engine 20. This easily minimizes the generation of vapor (vaporized fuel) in the pump main portion 46*a*. Note that the water jacket 331 is an example of the "first cooling section" according to a preferred embodiment of the present invention.

Figure 20:
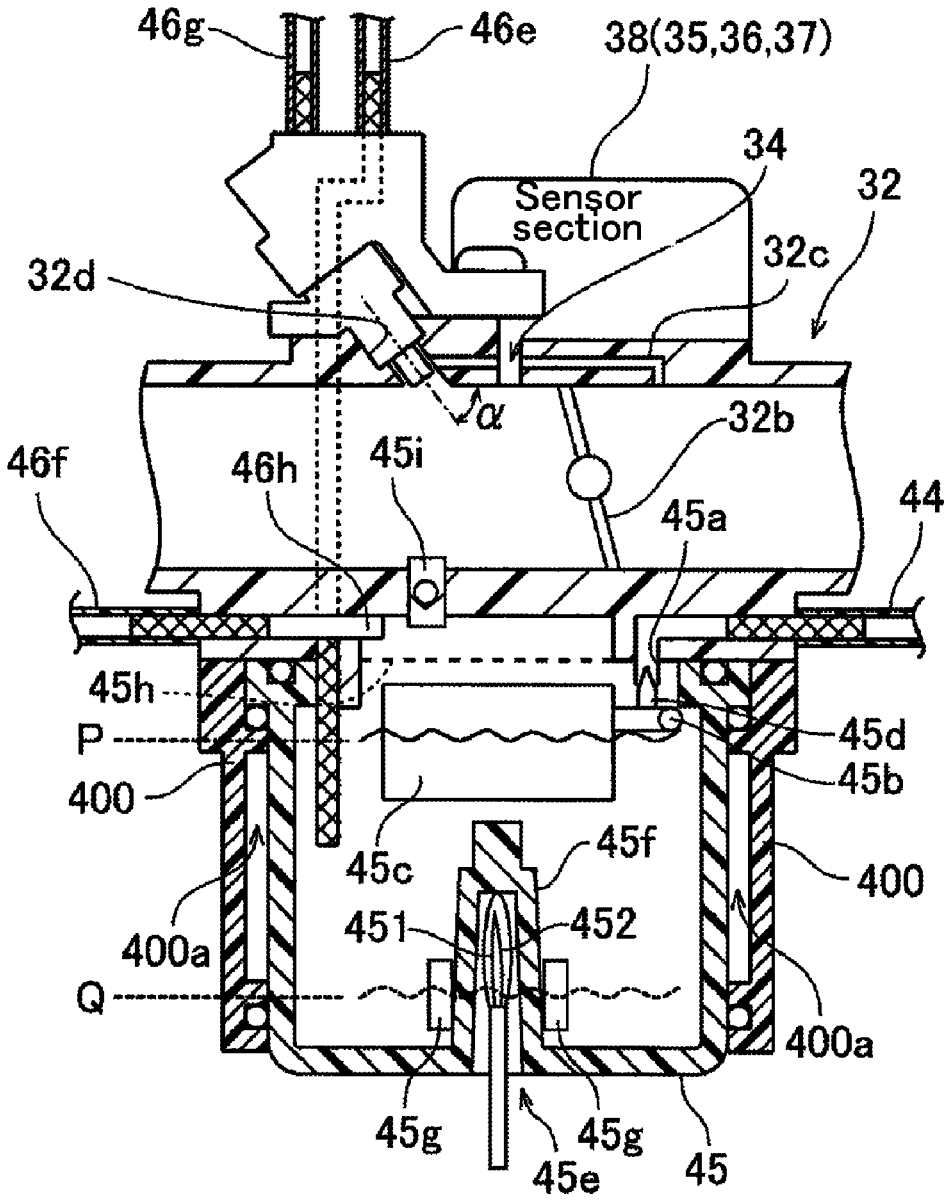
FIG. 20 is a schematic view showing a vapor separator tank of an outboard motor according to a fifth variation of a preferred embodiment of the present invention.
Figure 21:
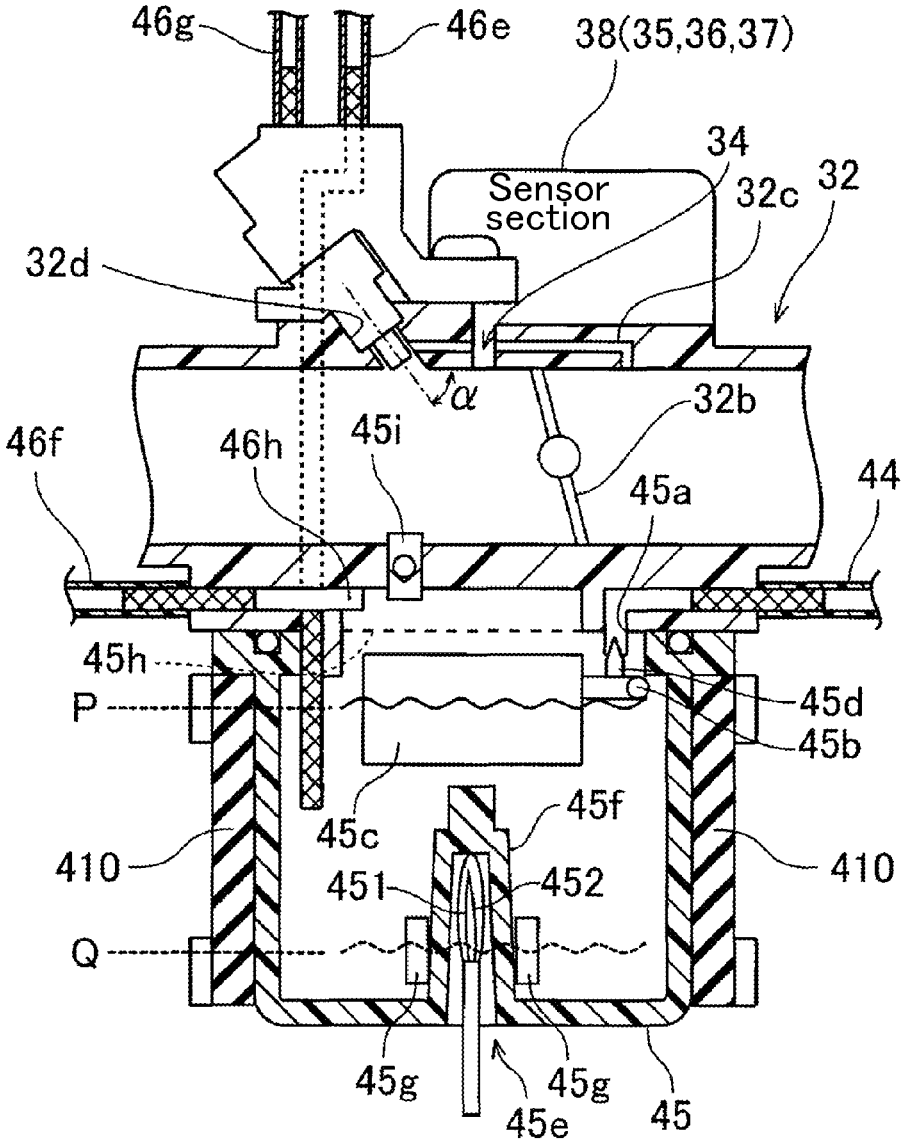
FIG. 21 is a schematic view showing a vapor separator tank of an outboard motor according to a sixth variation of a preferred embodiment of the present invention.
Figure 22:
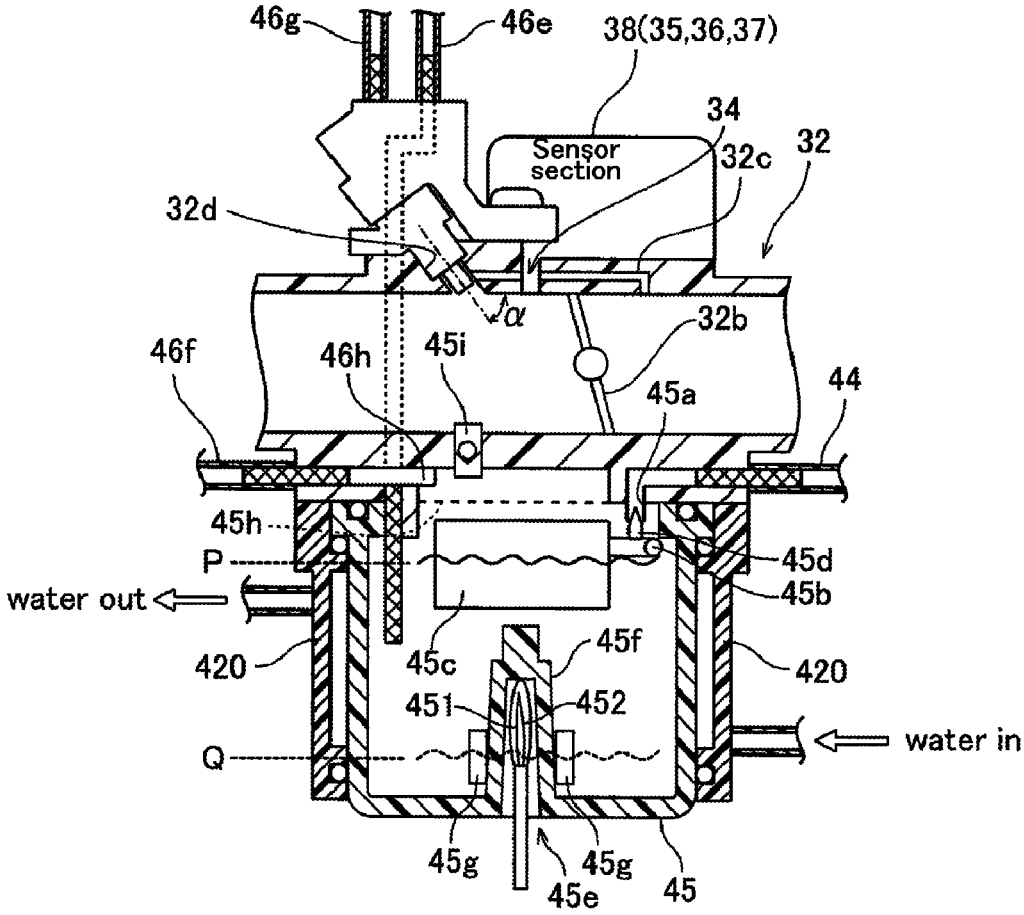
FIG. 22 is a schematic view showing a vapor separator tank of an outboard motor according to a seventh variation of a preferred embodiment of the present invention.

In the above preferred embodiments, the vapor separator tank 45 is preferably made of resin, thereby minimizing an increase in the fuel temperature in the vapor separator tank 45 that is caused by the heat radiated from the engine 20. However, the present invention is not limited thereto. As in a fifth variation shown in FIG. 20, an air containing member 400 surrounding the vapor separator tank 45 may be provided to form an air layer 400*a* therebetween. Or, as in a sixth variation shown in FIG. 21, a heat insulator 410 may be provided outside of and surrounding the vapor separator tank 45. Note that the air layer 400*a* and the heat insulator 410 are examples of the "heat insulating structure" according to a preferred embodiment of the present invention. Moreover, as in a seventh variation shown in FIG. 22, a water jacket 420 through which seawater passes may be provided outside of and surrounding the vapor separator tank 45 to cool the vapor separator tank 45. The water jacket 420 cools the fuel in the vapor separator tank 45 with the seawater passing therethrough, thereby minimizing an increase in the fuel temperature in the vapor separator tank 45 that is caused by the heat radiated from the engine section 2. This easily minimizes generation of vapor in the vapor separator tank 45. Note that the water jacket 420 is an example of the "second cooling section" according to a preferred embodiment of the present invention.

In the above preferred embodiments, an in-line fuel pump is utilized in which the high-pressure fuel pump 46 is disposed outside the vapor separator tank 45. However, the present invention is not limited thereto. In the case where the pump main portion 46*a* is driven by the driving force of the engine, a fuel pump may be provided inside the vapor separator tank 45. In the case where a pump main portion is driven by the driving force of the engine, the fuel pump is not heated unlike in the case where a motor is utilized. This minimizes an increase in the fuel temperature in the vapor separator tank 45.

In the above preferred embodiments, the low-pressure fuel pump 43 is cooled by the water-cooling section 43*c*. However, the present invention is not limited thereto. The low-pressure fuel pump may be made of resin as a base material. Or, an insulator or an air layer may be provided outside the low-pressure fuel pump to insulate the heat that is radiated by the engine 20 or the heat that is directly transmitted from the engine 20.

In the above preferred embodiments, the configuration in which fuel is returned from the high-pressure fuel pump 46 to the vapor separator tank 45 via the relief valve 468 is described. However, the present invention is not limited thereto. Fuel may be returned to the filter 464 of the high-pressure fuel pump 46 via the relief valve 468.

In the above preferred embodiments, gasoline is preferably used for fuel. However, the present invention is not limited thereto. The fuel may be alcohol.

In the above preferred embodiments, the fuel supply system is preferably used in the outboard motor 1. However, the present invention is not limited thereto. The fuel supply system may be used in an inboard motor in which an engine section is mounted on a hull or to an inboard/outboard motor (stern drive).

In the above preferred embodiments, the high-pressure fuel pump 46 and the vapor separator tank 45 are supported by the throttle body 32 of the intake system 30. However, the present invention is not limited thereto. The high-pressure fuel pump 46 and the vapor separator tank 45 may be supported by another component. For example, the high-pressure fuel pump 46 and the vapor separator tank 45 may be supported by a component such as a bracket fixed to the engine.

Figure 23:
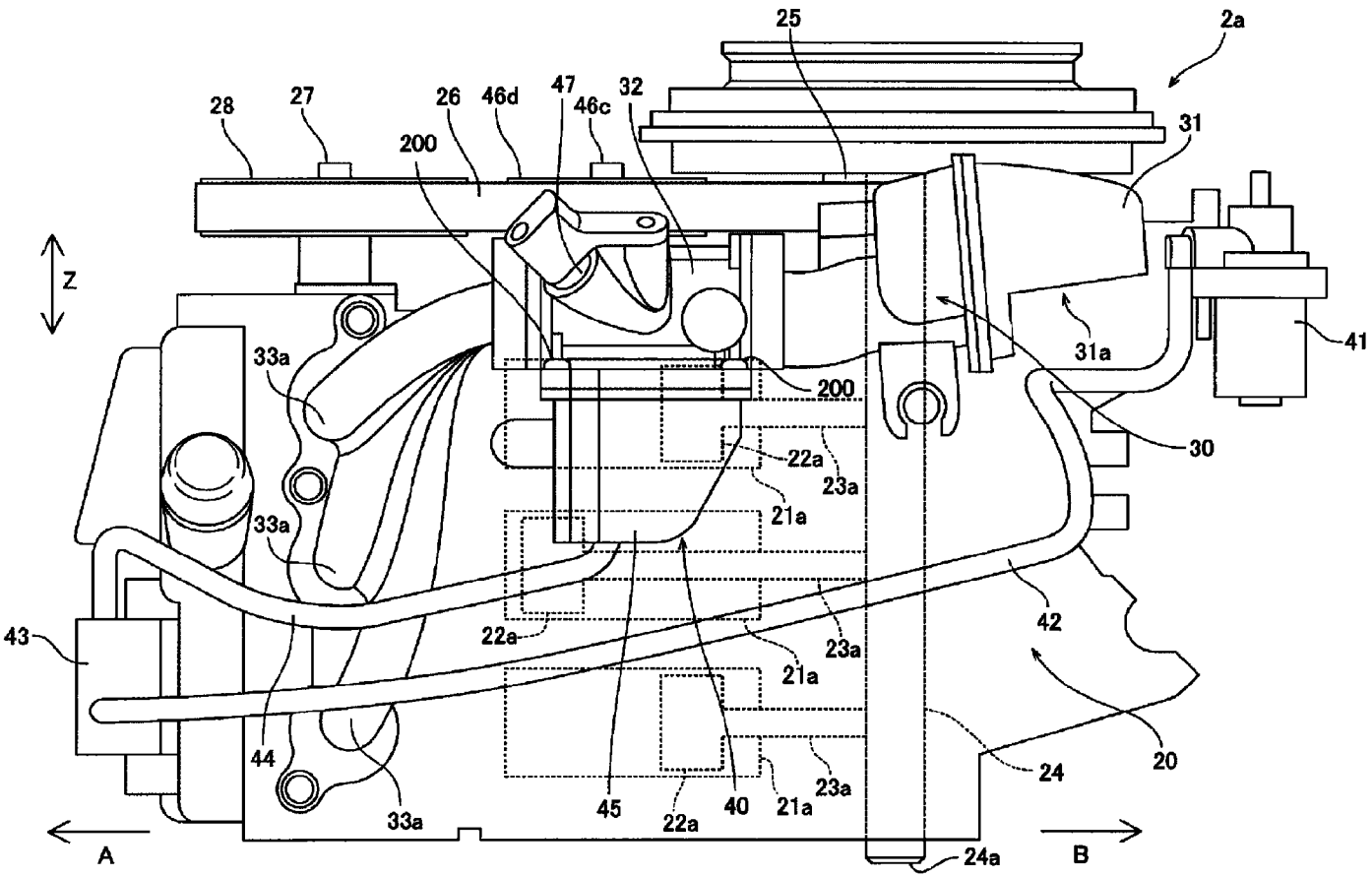
FIG. 23 is a side view of an engine section according to an eighth variation of a preferred embodiment of the present invention.
Figure 24:
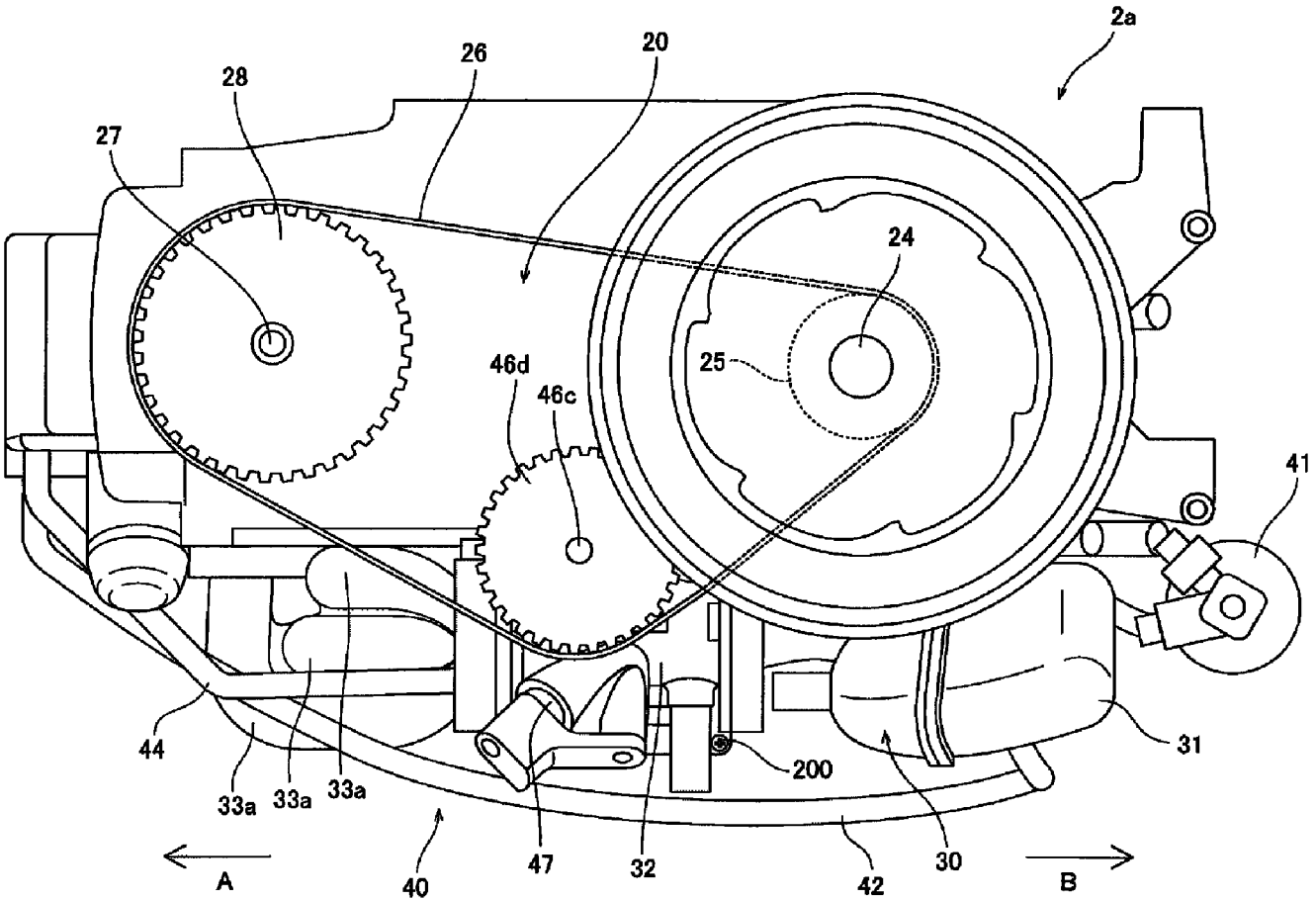
FIG. 24 is a plan view of the engine section according to the eighth variation of a preferred embodiment of the present invention.

In the above preferred embodiments, the present invention is applied to the outboard motor 1 that utilizes the two-cylinder engine section 2 with the two cylinders 21. However, the present invention is not limited thereto. The present invention may be applied to an outboard motor utilizing an engine section with one cylinder or more than two cylinders. For example, a three-cylinder engine section 2*a* according to an eighth variation shown in FIGS. 23 and 24 includes three cylinders 21*a*, each of which has a piston 22*a* and a connecting rod 23*a*. The engine section 2*a* is connected to the throttle body 32 and includes three intake pipes 33*a* that are each connected to an intake port (not shown) of each of the three cylinders 21*a*. The construction other than the above is similar to that of the engine section 2 in the outboard motor 1.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A fuel supply system for a boat, the fuel supply system comprising:

a second fuel tank to receive fuel from a first fuel tank mounted on a hull of the boat and to contain fuel therein;

a fuel injection device to supply fuel to an engine on the boat; and a fuel supply pump including a pump main portion including a fuel passage inside the pump main portion and a pump driving section separate from the fuel passage of the pump main portion; wherein the fuel supply pump is located in fluid communication between the second fuel tank and the fuel injection device and supplies the fuel contained in the second fuel tank to the fuel injection device;

the fuel supply pump is located outside the second fuel tank; and the fuel supply pump further includes a pressure adjusting device to return fuel to the second fuel tank when the pressure of the fuel supplied to the fuel injection device is equal to or larger than a predetermined value.

2. The fuel supply system for a boat according to claim 1, wherein the pump driving section drives the pump main portion by a driving force of the engine.

3. The fuel supply system for a boat according to claim 1, wherein the pump driving section drives the pump main portion by a driving force of a motor separate from the fuel passage of the pump main portion.

4. The fuel supply system for a boat according to claim 1, wherein the pump driving section includes a pulley to receive a driving force, and the pulley drives a rotary shaft extending into the pump main portion.

5. The fuel supply system for a boat according to claim 1, wherein the second fuel tank and the fuel supply pump are spaced from the engine.

6. The fuel supply system for a boat according to claim 1, wherein the second fuel tank includes a vapor separator tank to separate vaporized fuel from liquid fuel, and the pressure adjusting device returns fuel to the vapor separator tank when the pressure of the fuel supplied to the fuel injection device is equal to or larger than the predetermined value.

7. The fuel supply system for a boat according to claim 1, wherein the fuel supply pump includes a heat insulating structure to insulate the fuel supply pump from heat radiated by the engine.

8. The fuel supply system for a boat according to claim 7, wherein the pump main portion of the fuel supply pump is made of resin which defines the heat insulating structure.

9. The fuel supply system for a boat according to claim 1, wherein the fuel supply pump includes a cooling section to cool the pump main portion.

10. The fuel supply system for a boat according to claim 1, wherein the second fuel tank includes a heat insulating structure to insulate the second fuel tank from heat radiated by the engine.

11. The fuel supply system for a boat according to claim 10, wherein the second fuel tank is made of resin which defines the heat insulating structure.

12. The fuel supply system for a boat according to claim 1, wherein the second fuel tank includes a cooling section to cool the second fuel tank.

13. The fuel supply system for a boat according to claim 1, further comprising:

a fuel transport pump located in fluid communication between the first fuel tank and the second fuel tank to transport fuel from the first fuel tank to the second fuel tank; wherein the fuel transport pump includes a cooling section to cool the fuel transport pump.

14. An outboard motor comprising:

a second fuel tank to receive fuel from a first fuel tank mounted on a hull of a boat and to contain fuel therein;

an engine;

a fuel injection device to supply fuel to the engine; and a fuel supply pump including a pump main portion including a fuel passage inside the pump main portion and a pump driving section separate from the fuel passage of the pump main portion; wherein the fuel supply pump is located in fluid communication between the second fuel tank and the fuel injection device and supplies the fuel contained in the second fuel tank to the fuel injection device;

the fuel supply pump is located outside the second fuel tank; and the fuel supply PUMP further includes a pressure adjusting device to return fuel to the second fuel tank when the pressure of the fuel supplied to the fuel injection device is equal to or larger than a predetermined value.

15. The fuel supply system for a boat according to claim 14, wherein the pump driving section includes a pulley to receive a driving force, and the pulley drives a rotary shaft extending into the pump main portion.

* * * * *